US011466517B2

(12) United States Patent
Donderici et al.

(10) Patent No.: US 11,466,517 B2
(45) Date of Patent: Oct. 11, 2022

(54) DETERMINING FORMATION CHARACTERISTICS USING REFERENCE SENSOR RESPONSES RECORDED DURING PULSED DRILLING

(71) Applicant: Halliburton Energy Services, Inc., Houston, TX (US)

(72) Inventors: Burkay Donderici, Pittsford, NY (US); Reza Khalaj Amineh, Leonia, NJ (US)

(73) Assignee: Halliburton Energy Services, Inc., Houston, TX (US)

( * ) Notice: Subject to any disclaimer, the term of this patent is extended or adjusted under 35 U.S.C. 154(b) by 0 days.

(21) Appl. No.: 17/056,300

(22) PCT Filed: Jun. 20, 2018

(86) PCT No.: PCT/US2018/038399

§ 371 (c)(1),
(2) Date: Nov. 17, 2020

(87) PCT Pub. No.: WO2019/245542

PCT Pub. Date: Dec. 26, 2019

(65) Prior Publication Data

US 2021/0293127 A1 Sep. 23, 2021

(51) Int. Cl.
*E21B 7/15* (2006.01)
*E21B 47/013* (2012.01)
(Continued)

(52) U.S. Cl.
CPC ..... *E21B 7/15* (2013.01); *E21B 44/00* (2013.01); *E21B 47/013* (2020.05); *E21B 47/13* (2020.05); *E21B 47/14* (2013.01); *E21B 49/003* (2013.01)

(58) Field of Classification Search
CPC ..... E21B 7/14; E21B 7/15
See application file for complete search history.

(56) References Cited

U.S. PATENT DOCUMENTS 4,652,828 A 3/1987 Kenyon et al.
5,780,784 A 7/1998 Robbins
(Continued)

OTHER PUBLICATIONS

International Search Report and Written Opinion received for PCT Patent Application No. PCT/US2018/038399, dated Feb. 28, 2019; 18 pages.
(Continued)

*Primary Examiner* — Kristyn A Hall
(74) *Attorney, Agent, or Firm* — Delizio, Peacock, Lewin & Guerra

(57) ABSTRACT

A downhole drilling system is disclosed. The system may include a drill bit including first and second electrodes electrically coupled to a pulse-generating circuit to receive pulse drilling signals, a reference sensor in proximity to the drill bit, an additional sensor uphole from the reference sensor, and a sensor analysis system communicatively coupled to the reference sensor and to the additional sensor. The sensor analysis system may be configured to obtain measurements representing responses recorded simultaneously by the reference sensor and by the additional sensor during a pulsed drilling operation in a wellbore, generate modified measurements in which effects of variations in the pulse drilling signal on the measurements representing responses recorded by the additional sensor are reduced based on the measurements representing responses recorded by the reference sensor and determine, based on the modified measurements, a characteristic of a formation downhole from the drill bit.

37 Claims, 13 Drawing Sheets

(51) Int. Cl.

| | |
|---|---|
| ***E21B 47/13*** | (2012.01) |
| ***E21B 44/00*** | (2006.01) |
| ***E21B 47/14*** | (2006.01) |
| ***E21B 49/00*** | (2006.01) |

(56) References Cited

U.S. PATENT DOCUMENTS

| | | | | |
|---|---|---|---|---|
| 5,870,690 | A | 2/1999 | Frenkel et al. | |
| 6,480,118 | B1 | 11/2002 | Rao | |
| 6,837,332 | B1 | 1/2005 | Rodney | |
| 2010/0212962 | A1 | 8/2010 | Rosten et al. | |
| 2018/0058211 | A1* | 3/2018 | Liang | G01V 1/282 |

OTHER PUBLICATIONS

Esmersoy, C., et al., "Reducing Uncertainty Ahead of the Bit," *Oilfield Review* 27, No. 1: 14-25, May 2015.

Examination Report received from GCC Patent Office for GC 2019/37577, dated Jun. 30, 2020, 5 pages.

* cited by examiner

DETERMINING FORMATION CHARACTERISTICS USING REFERENCE SENSOR RESPONSES RECORDED DURING PULSED DRILLING

RELATED APPLICATIONS

This application is a U.S. National Stage Application of International Application No. PCT/US2018/038399 filed Jun. 20, 2018, which designates the United States.

TECHNICAL FIELD

The present disclosure relates generally to pulsed drilling operations and, more particularly, to systems and methods for determining formation characteristics using reference sensor responses recorded during pulsed drilling operations.

BACKGROUND

Electrocrushing drilling uses pulsed power technology to drill a wellbore in a rock formation. Pulsed power technology repeatedly applies a high electric potential across electrodes of a pulsed-power drill bit, which ultimately causes the surrounding rock to fracture. The fractured rock is carried away from the bit by drilling fluid and the bit advances downhole. Electrocrushing drilling operations may also be referred to as pulsed drilling operations.

BRIEF DESCRIPTION OF THE DRAWINGS

For a more complete understanding of the present disclosure and its features and advantages, reference is now made to the following description, taken in conjunction with the accompanying drawings, in which.

DETAILED DESCRIPTION

Figure 1:
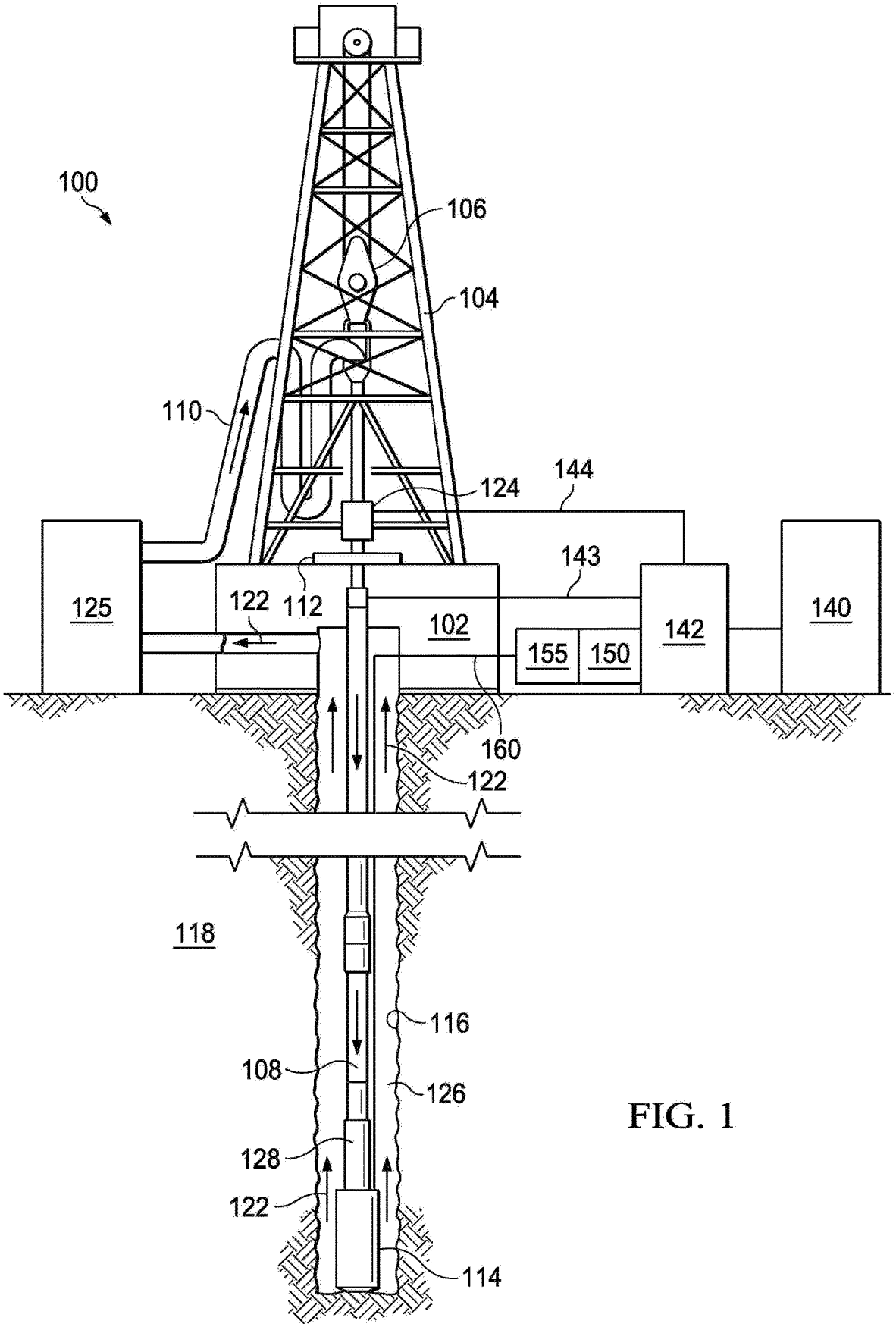
FIG. 1 is an elevation view of an exemplary pulsed-power drilling system used in a wellbore environment.

Electrocrushing drilling may be used to form wellbores in subterranean rock formations for recovering hydrocarbons, such as oil and gas, from these formations. Electrocrushing drilling uses pulsed-power technology to fracture the rock formation by repeatedly delivering electrical arcs or high-energy shock waves to the rock formation. More specifically, a drill bit of a pulsed-power drilling system is excited by a train of high-energy electrical pulses that produce high power discharges through the formation at the downhole end of the drill bit. The high-energy electrical pulses provide information about the properties of the formation and/or drilling fluid. The discharges produced by the high-energy electrical pulses, in turn, fracture part of the formation proximate to the drill bit and produce electromagnetic and acoustic waves that carry further information about properties of the formation.

Techniques for performing look ahead drilling in pulsed-power drilling systems may use acoustic, electrical and/or electromagnetic sensors positioned on the surface and/or downhole to record responses to received signals including, but not limited to, high-energy electrical pulses, electrical arcs, and the electromagnetic and acoustic waves that are received by the sensors during pulsed drilling operations. For example, electromagnetic and acoustic waves produced during a pulsed drilling operation may travel through and reflect off various layers in the formation before being received by the sensors. The shape and magnitude of the high-energy electrical pulses, electrical arcs, electromagnetic waves or acoustic waves received by the sensors carry information that may be used to estimate characteristics of the formation layers through which the electrical arcs or waves have passed. The propagation time of a given reflection may be indicative of the distance traveled and may be used to generate a map of the formation properties as a function of distance.

The sensors may convert the recorded responses into one or more measurements and send the measurements to a sensor analysis system. The measurements may include a voltage, a current, a ratio of voltage to current, an electric field strength, or a magnetic field strength associated with the flow of charge between two electrodes of the pulsed-power drill bit, or any combinations thereof. The sensor analysis system may analyze the measurements or store them for subsequent processing. For example, the sensor analysis system may process the measurements received from the sensors to determine characteristics of the formation through which the electromagnetic and acoustic waves pass and/or for other purposes based on the measurements received from the sensors.

Pulsed-power drilling systems may include one or more reference sensors positioned near the drill bit in addition to one or more receiving sensors farther away from the drill bit. The measurements provided to the sensor analysis system by the receiving sensors may be normalized or otherwise modified, prior to processing by the sensor analysis system, to reduce the effects of variations in the pulse drilling signals based on measurements provided to the sensor analysis system by the reference sensors.

There are numerous ways in which a pulsed-power drilling system may determine formation characteristics using reference sensor responses recorded during pulsed drilling operations. Thus, embodiments of the present disclosure and its advantages are best understood by referring to FIGS. 1 through 9, where like numbers are used to indicate like and corresponding parts.

FIG. 1 is an elevation view of an exemplary pulsed-power drilling system used to form a wellbore in a subterranean formation. Although FIG. 1 shows land-based equipment, downhole tools incorporating teachings of the present disclosure may be satisfactorily used with equipment located on offshore platforms, drill ships, semi-submersibles, and drilling barges (not expressly shown). Additionally, while wellbore 116 is shown as being a generally vertical wellbore, wellbore 116 may be any orientation including generally horizontal, multilateral, or directional.

Drilling system 100 includes drilling platform 102 that supports derrick 104 having traveling block 106 for raising and lowering drill string 108. Drilling system 100 may also include pump 125, which circulates drilling fluid 122 through a feed pipe to kelly 110, which in turn conveys drilling fluid 122 downhole through interior channels of drill string 108 and through one or more fluid flow ports in pulsed-power drill bit 114. Drilling fluid 122 circulates back to the surface via annulus 126 formed between drill string 108 and the sidewalls of wellbore 116. Fractured portions of the formation are carried to the surface by drilling fluid 122 to remove those fractured portions from wellbore 116.

Pulsed-power drill bit 114 is attached to the distal end of drill string 108 and may be an electrocrushing drill bit or an electrohydraulic drill bit. Power may be supplied to drill bit 114 from components downhole, components at the surface and/or a combination of components downhole and at the surface. For example, generator 140 may generate electrical power and provide that power to power-conditioning unit 142. Power-conditioning unit 142 may then transmit electrical energy downhole via surface cable 143 and a subsurface cable (not expressly shown in FIG. 1) contained within drill string 108 or attached to the side of drill string 108. A pulse-generating circuit within BHA 128 may receive the electrical energy from power-conditioning unit 142, and may generate high-energy electrical pulses to drive drill bit 114. The pulse-generating circuit may include a power source input, including two input terminals, and a first capacitor coupled between the input terminals. The pulse-generating circuit may also include a switch, a transformer, and a second capacitor whose terminals are coupled to respective electrodes of drill bit 114. The switch may include a mechanical switch, a solid-state switch, a magnetic switch, a gas switch, or any other type of switch suitable to open and close the electrical path between the power source input and a first winding of the transformer. The transformer generates a current through a second winding when the switch is closed and current flows through first winding. The current through the second winding charges the second capacitor. As the voltage across the second capacitor increases, the voltage across the electrodes of the drill bit increases.

The pulse-generating circuit within BHA 128 may be utilized to repeatedly apply a large electric potential, for example up to or exceeding 150 kV, across the electrodes of drill bit 114. Each application of electric potential is referred to as a pulse. When the electric potential across the electrodes of drill bit 114 is increased enough during a pulse to generate a sufficiently high electric field, an electrical arc forms through rock formation 118 at the bottom of wellbore 116. The arc temporarily forms an electrical coupling between the electrodes of drill bit 114, allowing electric current to flow through the arc inside a portion of the rock formation at the bottom of wellbore 116. The arc greatly increases the temperature and pressure of the portion of the rock formation through which the arc flows and the surrounding formation and materials. The temperature and pressure is sufficiently high to break the rock itself into small bits or cuttings. This fractured rock is removed, typically by drilling fluid 122, which moves the fractured rock away from the electrodes and uphole. The terms "uphole" and "downhole" may be used to describe the location of various components of drilling system 100 relative to drill bit 114 or relative to the bottom of wellbore 116 shown in FIG. 1, rather than to describe relative directions in terms of true up or true down. Therefore, if wellbore 116 is a horizontal wellbore or is otherwise angled away from vertical, the term "uphole" may refer to the direction away from drill bit 114, regardless of whether that direction is to the right, to the left, up, or down relative to drill bit 114. For example, a first component described as uphole from a second component may be further away from drill bit 114 and/or the bottom of wellbore 116 than the second component. Similarly, a first component described as being downhole from a second component may be located closer to drill bit 114 and/or the bottom of wellbore 116 than the second component. The electrical arc may also generate acoustic and/or electromagnetic waves that are transmitted within rock formation 118 and/or drilling fluid 122. Sensors placed within wellbore 116 and/or on the surface may record responses to high-energy electrical pulses, electrical arcs, acoustic waves and/or electromagnetic waves. Sensor analysis system 150 may receive measurements representing the recorded responses and may analyze the measurements to determine characteristics of rock formation 118 or for other purposes.

Wellbore 116, which penetrates various subterranean rock formations 118, is created as drill bit 114 repeatedly fractures the rock formation and drilling fluid 122 moves the fractured rock uphole. Wellbore 116 may be any hole formed into a subterranean formation or series of subterranean formations for the purpose of exploration or extraction of natural resources such as, for example, hydrocarbons, or for the purpose of injection of fluids such as, for example, water, wastewater, brine, or water mixed with other fluids. Additionally, wellbore 116 may be any hole drilled into a subterranean formation or series of subterranean formations for the purpose of geothermal power generation.

Although pulsed-power drill bit 114 is described above as implementing electrocrushing drilling, pulsed-power drill bit 114 may also be used for electrohydraulic drilling. In electrohydrulic drilling, rather than generating an electrical arc within the rock, drill bit 114 applies a large electrical potential across the one or more electrodes and a ground ring to form an arc across the drilling fluid proximate to the downhole end of wellbore 116. The high temperature of the arc vaporizes the portion of the drilling fluid immediately surrounding the arc, which in turn generates a high-energy shock wave in the remaining fluid. The one or more electrodes of electrohydraulic drill bit may be oriented such that the shock wave generated by the arc is transmitted toward the bottom of wellbore 116. When the shock wave contacts and bounces off of the rock at the bottom of wellbore 116, the rock fractures. Accordingly, wellbore 116 may be formed in subterranean formation 118 using drill bit 114 that implements either electrocrushing or electrohydroulic drilling.

Figure 8:
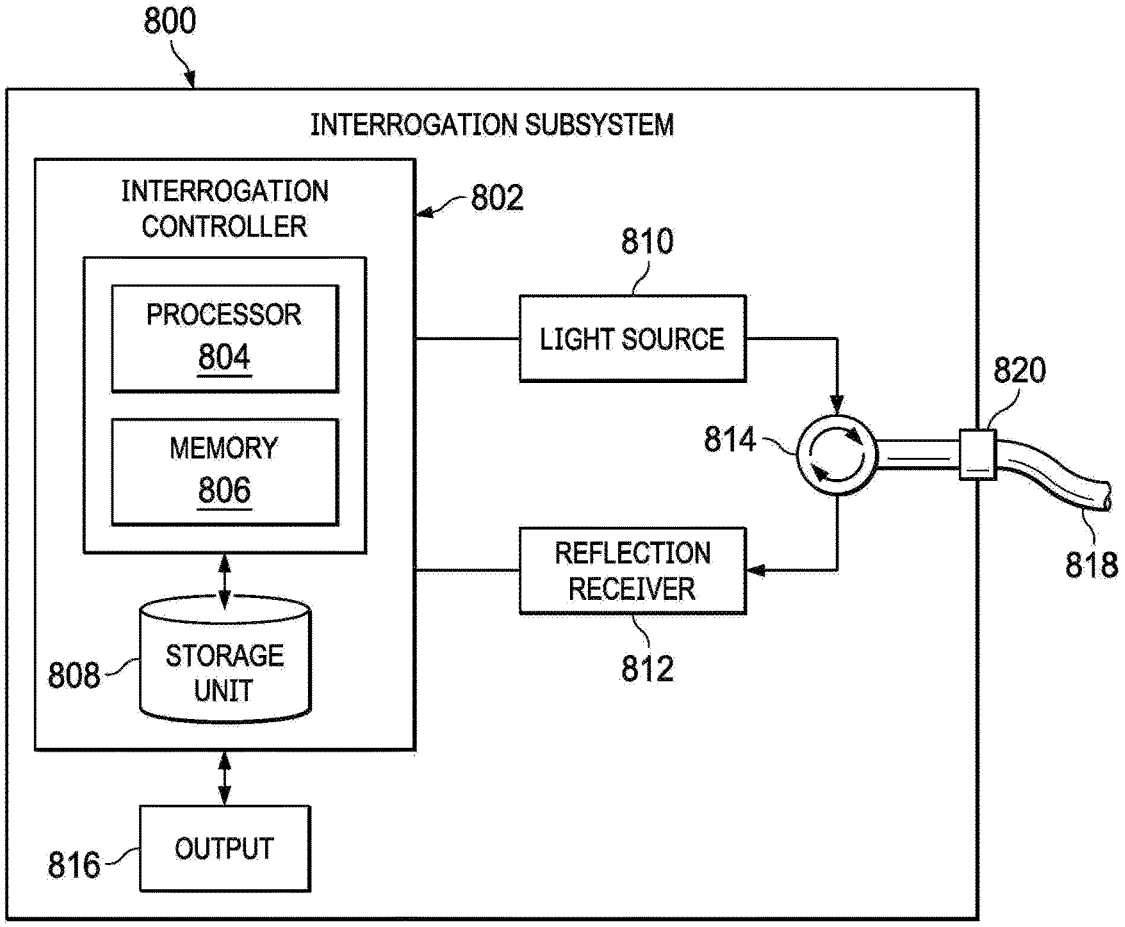
FIG. 8 is a block diagram illustrating an exemplary distributed acoustic sensing subsystem.

Distributed acoustic sensing (DAS) subsystem 155 may be positioned at the surface for use with pulsed-power drilling system 100, or at any other suitable location. DAS subsystem 155 may be coupled to optical fiber 160, which is positioned within a portion of the pulsed-power drilling system 100. For example, optical fiber 160 may be positioned within wellbore 116. Any suitable number of DAS subsystems (each coupled to an optical fiber 160 located downhole) may be placed inside or adjacent to wellbore 116. With optical fiber 160 positioned inside a portion of wellbore 116, DAS subsystem 155 may determine characteristics associated with formation 118 based on changes in strain caused by acoustic waves. DAS subsystem 155 may be configured to transmit optical pulses into optical fiber 160, and to receive and analyze reflections of the optical pulse to detect changes in strain caused by acoustic waves. An example DAS subsystem is illustrated in FIG. 8 and described in more detail below.

Figure 9:
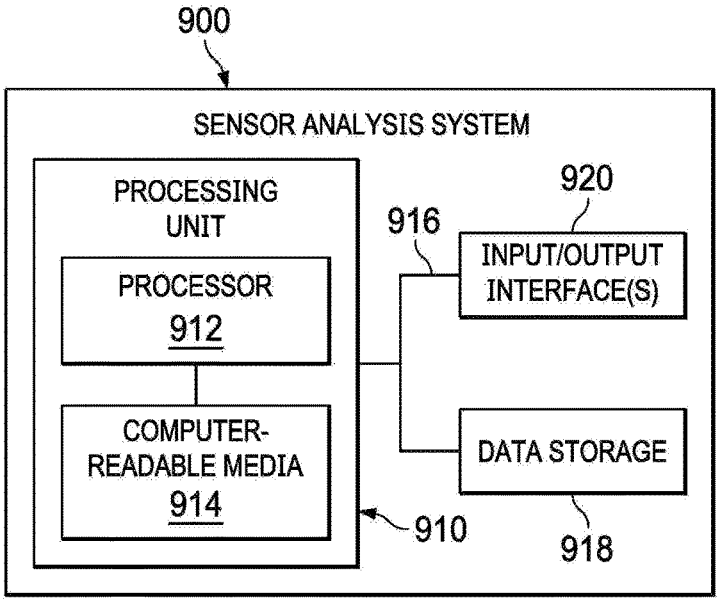
FIG. 9 is a block diagram illustrating an exemplary sensor analysis system associated with a pulsed-power drilling system.

Sensor analysis system 150 may be positioned at the surface for use with pulsed-power drilling system 100 as illustrated in FIG. 1, or at any other suitable location. Any suitable telemetry system may be used for communicating signals from various acoustic, electrical or electromagnetic sensors at the surface or downhole to sensor analysis system 150 during a pulsed drilling operation. For example, sensor analysis system 150 may be coupled to optical fiber 160 that extends downhole in wellbore 116. More specifically, one or more input/output interfaces of sensor analysis system 150 may be coupled to optical fiber 160 for communication to and from acoustic, electrical or electromagnetic sensors positioned downhole. For example, the sensors may transmit measurements to sensor analysis system 150. Any suitable number of sensor analysis systems 150 (each of which may be coupled to an optical fiber located downhole) may be placed inside or adjacent to wellbore 116. An example sensor analysis system is illustrated in FIG. 9 and described in more detail below.

Optical fiber 160 may be enclosed within a cable, rope, line, or wire. More specifically, optical fiber 160 may be enclosed within a slickline, a wireline, coiled tubing, or another suitable conveyance for suspending a downhole tool in wellbore 116. Optical fiber 160 may be charged by a laser to provide power to DAS subsystem 155, sensor analysis system 150, or sensors located within wellbore 116.

Figure 2A:
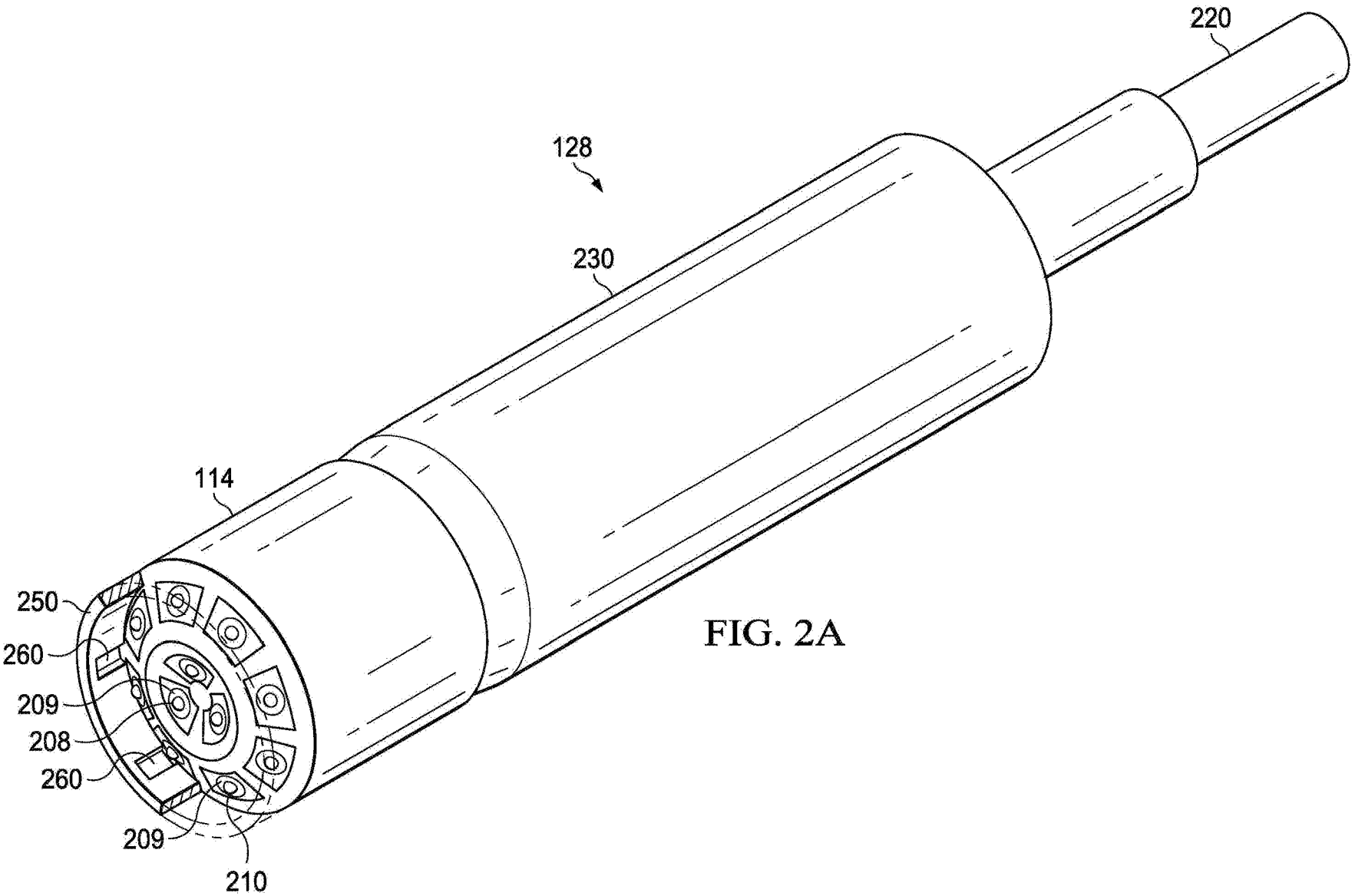
FIG. 2A is a perspective view of exemplary components of a bottom-hole assembly for a pulsed-power drilling system.

FIG. 2A is a perspective view of exemplary components of a bottom-hole assembly for a pulsed-power drilling system. BHA 128 may include pulsed-power tool 230 and drill bit 114. For the purposes of the present disclosure, drill bit 114 may be integrated within BHA 128, or may be a separate component coupled to BHA 128. Pulsed-power tool 230 may provide pulsed electrical energy to drill bit 114.

Pulsed-power tool 230 receives electrical power from a power source via cable 220. For example, pulsed-power tool 230 may receive electrical power via cable 220 from a power source located on the surface as described above with reference to FIG. 1, or from a power source located downhole such as a generator powered by a mud turbine. Pulsed-power tool 230 may also receive electrical power via a combination of a power source located on the surface and a power source located downhole. Drill bit 114 may include ground ring 250, shown in part in FIG. 2A. Ground ring 250 may function as an electrode. Pulsed-power tool 230 converts electrical power received from the power source into high-energy electrical pulses that are applied across electrodes 208 and ground ring 250 of drill bit 114. Pulsed-power tool 230 may also apply high-energy electrical pulses across electrode 210 and ground ring 250 in a similar manner as described for electrode 208 and ground ring 250. Pulsed-power tool 230 may include a pulse-generating circuit as described above as described above in reference to FIG. 1.

Although illustrated as a contiguous ring in FIG. 2A, ground ring 250 may be non-contiguous discrete electrodes and/or implemented in different shapes. Each of electrodes 208 and 210 may be positioned at a minimum distance from ground ring 250 of approximately 0.4 inches and at a maximum distance from ground ring 250 of approximately 4 inches. The distance between electrodes 208 or 210 and ground ring 250 may be based on the parameters of the pulsed drilling operation and/or on the diameter of drill bit 114. For example, the distance between electrodes 208 or 210 and ground ring 250, at their closest spacing, may be at least 0.4 inches, at least 1 inch, at least 1.5 inches, or at least 2 inches.

Referring to FIG. 1 and FIG. 2A, drilling fluid 122 is typically circulated through drilling system 100 at a flow rate sufficient to remove fractured rock from the vicinity of drill bit 114. In addition, drilling fluid 122 may be under sufficient pressure at a location in wellbore 116, particularly a location near a hydrocarbon, gas, water, or other deposit, to prevent a blowout. Drilling fluid 122 may exit drill string 108 via openings 209 surrounding each of electrodes 208 and 210. The flow of drilling fluid 122 out of openings 209 allows electrodes 208 and 210 to be insulated by the drilling fluid. A solid insulator (not expressly shown) may surround electrodes 208 and 210 on drill bit 114. Drill bit 114 may also include one or more fluid flow ports 260 on the face of drill bit 114 through which drilling fluid 122 exits drill string 108, for example fluid flow ports 260 on ground ring 250. Fluid flow ports 260 may be simple holes, or they may be nozzles or other shaped features. Because fines are not typically generated during pulsed-power drilling, as opposed to mechanical drilling, drilling fluid 122 may not need to exit the drill bit at as high a pressure as the drilling fluid in mechanical drilling. As a result, nozzles and other features used to increase drilling fluid pressure may not be needed on drill bit 114. However, nozzles or other features to increase drilling fluid 122 pressure or to direct drilling fluid may be included for some uses. Additionally, the shape of a solid insulator, if present, may be selected to enhance the flow of drilling fluid 122 around the components of drill bit 114.

If drilling system 100 experiences vaporization bubbles in drilling fluid 122 near drill bit 114, the vaporization bubbles may have deleterious effects. For instance, vaporization bubbles near electrodes 208 or 210 may impede formation of the arc in the rock. Drilling fluid 122 may be circulated at a flow rate also sufficient to remove vaporization bubbles from the vicinity of drill bit 114. Fluid flow ports 260 may permit the flow of drilling fluid 122 along with any fractured rock or vaporization bubbles away from electrodes 208 and 210 and uphole.

Figure 2B:
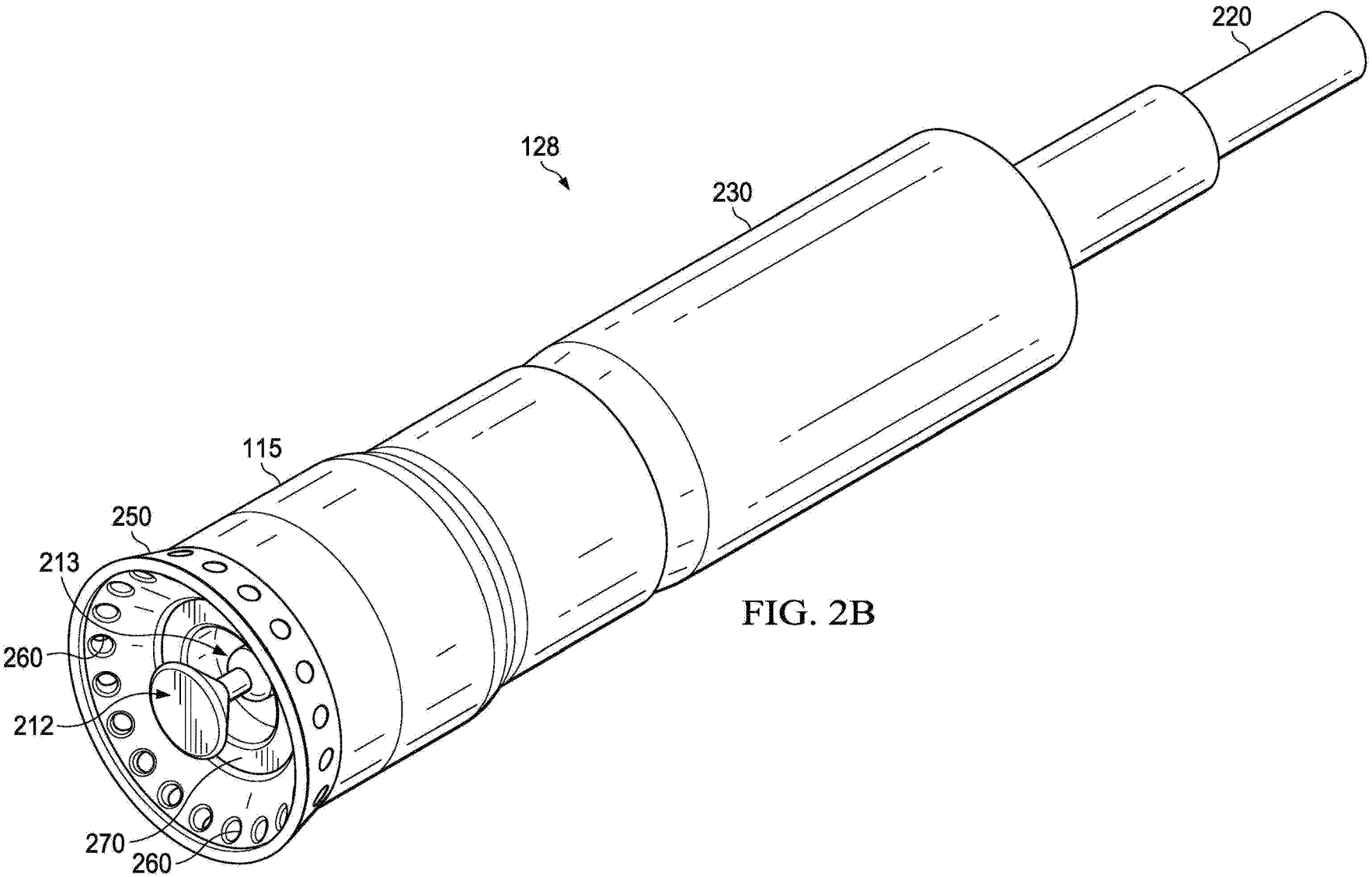
FIG. 2B is a perspective view of exemplary components of a bottom-hole assembly for a pulsed-power drilling system.

FIG. 2B is a perspective view of exemplary components of another bottom-hole assembly for a pulsed-power drilling system. BHA 128 may include pulsed-power tool 230 and drill bit 115. For the purposes of the present disclosure, drill bit 115 may be integrated within BHA 128, or may be a separate component that is coupled to BHA 128. BHA 128 and pulsed-power tool 230 may include features and functionalities similar to those discussed above in FIG. 2A.

Drill bit 115 may include bit body 255, electrode 212, ground ring 250, and solid insulator 270. Electrode 212 may be placed approximately in the center of drill bit 115. Electrode 212 may be positioned at a minimum distance from ground ring 250 of approximately 0.4 inches and at a maximum distance from ground ring 250 of approximately 4 inches. The distance between electrode 212 and ground ring 250 may be based on the parameters of the pulsed drilling operation and/or on the diameter of drill bit 115. For example, the distance between electrode 212 and ground ring 250, at their closest spacing, may be at least 0.4 inches, at least 1 inch, at least 1.5 inches, or at least 2 inches. The distance between electrode 212 and ground ring 250 may be generally symmetrical or may be asymmetrical such that the electric field surrounding the drill bit has a symmetrical or asymmetrical shape. The distance between electrode 212 and ground ring 250 allows drilling fluid 122 to flow between electrode 212 and ground ring 250 to remove vaporization bubbles from the drilling area. Electrode 212 may have any suitable diameter based on the pulsed drilling operation, on the distance between electrode 212 and ground ring 250, and/or on the diameter of drill bit 115. For example, electrode 212 may have a diameter between approximately 2 and approximately 10 inches (i.e., between approximately 51 and approximately 254 millimeters). Ground ring 250 may function as an electrode and provide a location on the drill bit where an electrical arc may initiate and/or terminate.

Drill bit 115 may include one or more fluid flow ports on the face of the drill bit through which drilling fluid exits the drill string 108. For example, ground ring 250 of drill bit 115 may include one or more fluid flow ports 260 such that drilling fluid 122 flows through fluid flow ports 260 carrying fractured rock and vaporization bubbles away from the drilling area. Fluid flow ports 260 may be simple holes, or they may be nozzles or other shaped features. Drilling fluid 122 is typically circulated through drilling system 100 at a flow rate sufficient to remove fractured rock from the vicinity of drill bit 115. In addition, drilling fluid 122 may be under sufficient pressure at a location in wellbore 116, particularly a location near a hydrocarbon, gas, water, or other deposit, to prevent a blowout. Drilling fluid 122 may exit drill string 108 via opening 213 surrounding electrode 212. The flow of drilling fluid 122 out of opening 213 allows electrode 212 to be insulated by the drilling fluid. Because fines are not typically generated during pulsed-power drilling, as opposed to mechanical drilling, drilling fluid 122 may not need to exit the drill bit at as high a pressure as the drilling fluid in mechanical drilling. As a result, nozzles and other features used to increase drilling fluid pressure may not be needed on drill bit 115. However, nozzles or other features to increase drilling fluid 122 pressure or to direct drilling fluid may be included for some uses. Additionally, the shape of solid insulator 270 may be selected to enhance the flow of drilling fluid 122 around the components of drill bit 115.

As described above with reference to FIGS. 1, 2A, and 2B, when the electric potential across electrodes of a pulsed-power drill bit becomes sufficiently large, an electrical arc forms through the rock formation and/or drilling fluid that is near the electrodes. The arc provides a temporary electrical short between the electrodes, and thus allows electric current to flow through the arc inside a portion of the rock formation and/or drilling fluid at the bottom of the wellbore. The arc increases the temperature of the portion of the rock formation through which the arc flows and the surrounding formation and materials. The temperature is sufficiently high to vaporize any water or other fluids that might be proximate to the arc and may also vaporize part of the rock itself. The vaporization process creates a high-pressure gas which expands and, in turn, fractures the surrounding rock.

Pulsed-power drilling systems and pulsed-power tools may utilize any suitable pulse-generating circuit topology to generate and apply high-energy electrical pulses across electrodes within the pulsed-power drill bit. Such pulse-generating circuit topologies may utilize electrical resonance to generate the high-energy electrical pulses required for pulsed-power drilling. The pulse-generating circuit may be shaped and sized to fit within the circular cross-section of pulsed-power tool 230, which as described above with reference to FIGS. 2A and 2B, may form part of BHA 128. The pulse-generating circuit may be enclosed within an encapsulant, such a thermally conductive material that protects the pulse-generating circuit from the wide range of temperatures (for example, from approximately 10 to approximately 200 degrees Centigrade) within the wellbore.

The pulsed-power drilling systems described herein may generate multiple electrical arcs per second using a specified excitation current profile that causes a transient electrical arc to form and arc through the most conducting portion of the wellbore floor. As described above, the arc causes that portion of the wellbore floor to disintegrate or fragment and be swept away by the flow of drilling fluid. As the most conductive portions of the wellbore floor are removed, subsequent electrical arcs may naturally seek the next most conductive portion. Therefore, obtaining measurements from which estimates of the excitation direction can be generated may provide information usable in determining characteristics of the formation.

Figure 3:
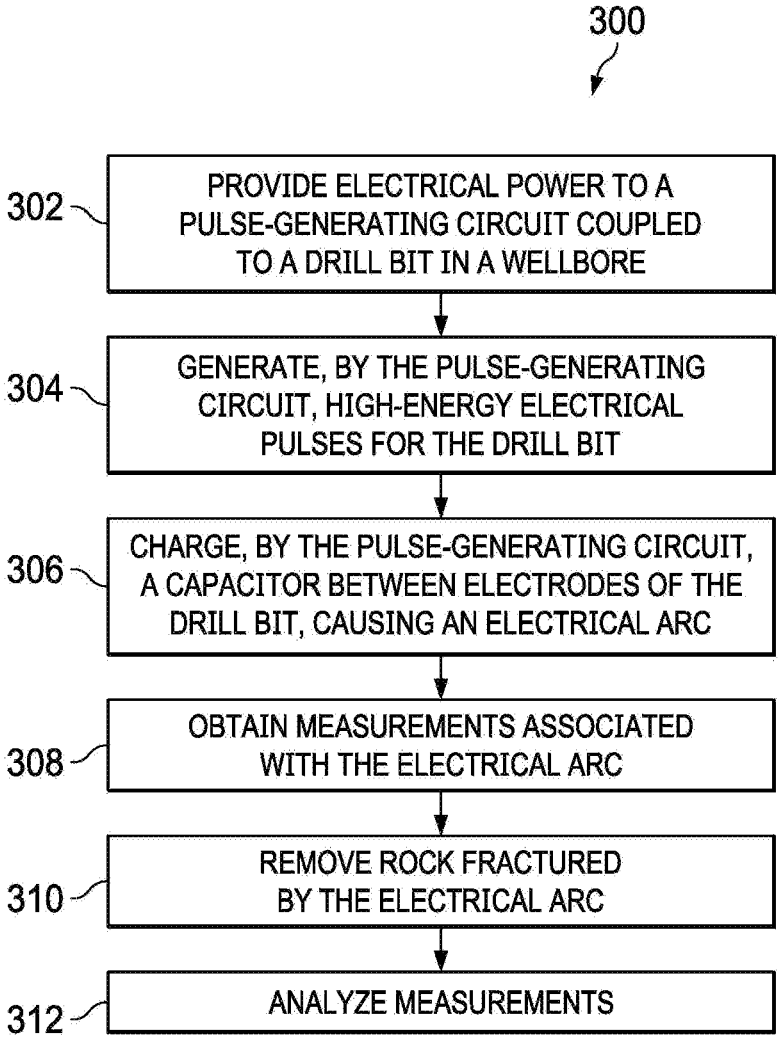
FIG. 3 is a flow chart illustrating an exemplary method for performing a pulsed drilling operation.

FIG. 3 is a flow chart illustrating an exemplary method for performing a pulsed drilling operation using an electrocrushing drill bit or an electrohydraulic drill bit placed downhole in a wellbore. For example, drill bit 114 illustrated in FIG. 2A or drill bit 115 illustrated in FIG. 2B may be placed downhole in wellbore 116 as shown in FIG. 1. Method 300 includes, at 302, providing electrical power to a pulse-generating circuit coupled to the drill bit. For example, the pulse-generating circuit may be coupled to a first electrode and a second electrode of the drill bit. The first electrode may be electrode 208, 210, or 212 and the second electrode may be ground ring 250 discussed above with respect to FIGS. 2A and 2B. The pulse-generating circuit may be implemented within pulsed-power tool 230 shown in FIGS. 2A and 2B, and may receive electrical power from a power source on the surface, from a power source located downhole, or from a combination of a power source on the surface and a power source located downhole. Electrical power may be supplied downhole to a pulse-generating circuit by way of a cable, such as cable 220 described above with respect to FIGS. 2A and 2B. The power may be provided to the pulse-generating circuit within pulse-power tool 230 at a power source input.

At 304, high-energy electrical pulses are generated by the pulse-generating circuit for the drill bit by converting the electrical power received from the power source into high-energy electrical pulses. For example, the pulse-generating circuit may use electrical resonance to convert a low-voltage power source (for example, approximately 1 kV to approximately 5 kV) into high-energy electrical pulses capable of applying at least 150 kV across electrodes of the drill bit.

At 306, the pulse-generating circuit charges a capacitor between electrodes of the drill bit, causing an electrical arc. For example, a switch located downhole within the pulse-generating circuit may close to charge a capacitor that is electrically coupled between the first electrode and the second electrode. The switch may close to generate a high-energy electrical pulse and may be open between pulses. The switch may be a mechanical switch, a solid-state switch, a magnetic switch, a gas switch, or any other type of switch. Accordingly, as the voltage across the capacitor increases, the voltage across the first electrode and the second electrode increases. As described above with reference to FIGS. 1, 2A and 2B, when the voltage across the electrodes becomes sufficiently large, an electrical arc may form through the drilling fluid and/or a rock formation that is proximate to the electrodes. The arc may provide a temporary electrical short between the electrodes, and thus may discharge, at a high current level, the voltage built up across the capacitor.

At 308, measurements associated with the electrical arc are obtained. For example, one or more acoustic, electrical and/or electromagnetic sensors may record responses to received signals including, but not limited to, high-energy electrical pulses, electrical arcs, or acoustic and/or electromagnetic waves produced by the electrical arc during a pulsed drilling operation, and may provide measurements representing the recorded responses to a sensor analysis system, such as sensor analysis system 150 illustrated in FIG. 1 or sensor analysis system 900 illustrated in FIG. 9.

As described above with reference to FIGS. 1, 2A and 2B, the electrical arc greatly increases the temperature of the portion of the rock formation through which the arc flows as well as the surrounding formation and materials, such that the rock formation at the bottom of the wellbore may be fractured with the electrical arc. The temperature may be sufficiently high to vaporize any water or other fluids that may be touching or near the arc and may also vaporize part of the rock itself. The vaporization process creates a high-pressure gas which expands and, in turn, fractures the surrounding rock. At 310, rock fractured by the electrical arc may be removed from the downhole end of the wellbore. For example, as described above with reference to FIG. 1, drilling fluid 122 may move the fractured rock away from the electrodes and uphole from the drill bit. As described above with respect to FIGS. 2A and 2B, drilling fluid 122 and the fractured rock may flow away from electrodes through fluid flow ports 260 on the face of the drill bit or on a ground ring of the drill bit.

At 312, the measurements obtained at 308 are analyzed to determine characteristics of the rock formation or for other purposes. In one example, a sensor analysis system, such as sensor analysis system 150 in FIG. 1, may use the measurements to determine formation characteristics ahead of (downhole from) the drill bit using reference sensor responses recorded during the pulsed drilling operation to normalize other sensor responses. The analysis may include one or more inversions, as described with respect to FIG. 5 and FIG. 6. In another example, the sensor analysis system may be configured to determine dispersion characteristics of the pulse drilling signals with respect to a borehole wave-propagation mode, such as a Stoneley or Flextural wave mode. The mode may be dependent on the frequency of the waves produced by the pulsed drilling operations. A dispersion correction based on the generated dispersion characteristics may be used in determining a characteristic of the formation ahead of the drill bit.

Modifications, additions, or omissions may be made to method 300 without departing from the scope of the disclosure. For example, the order of the steps may be performed in a different manner than that described and some steps may be performed at the same time. Additionally, each individual step may include additional steps without departing from the scope of the present disclosure. The operations of method 300 illustrated in FIG. 3 may be repeated, as needed, to perform a pulsed drilling operation.

Figure 4:
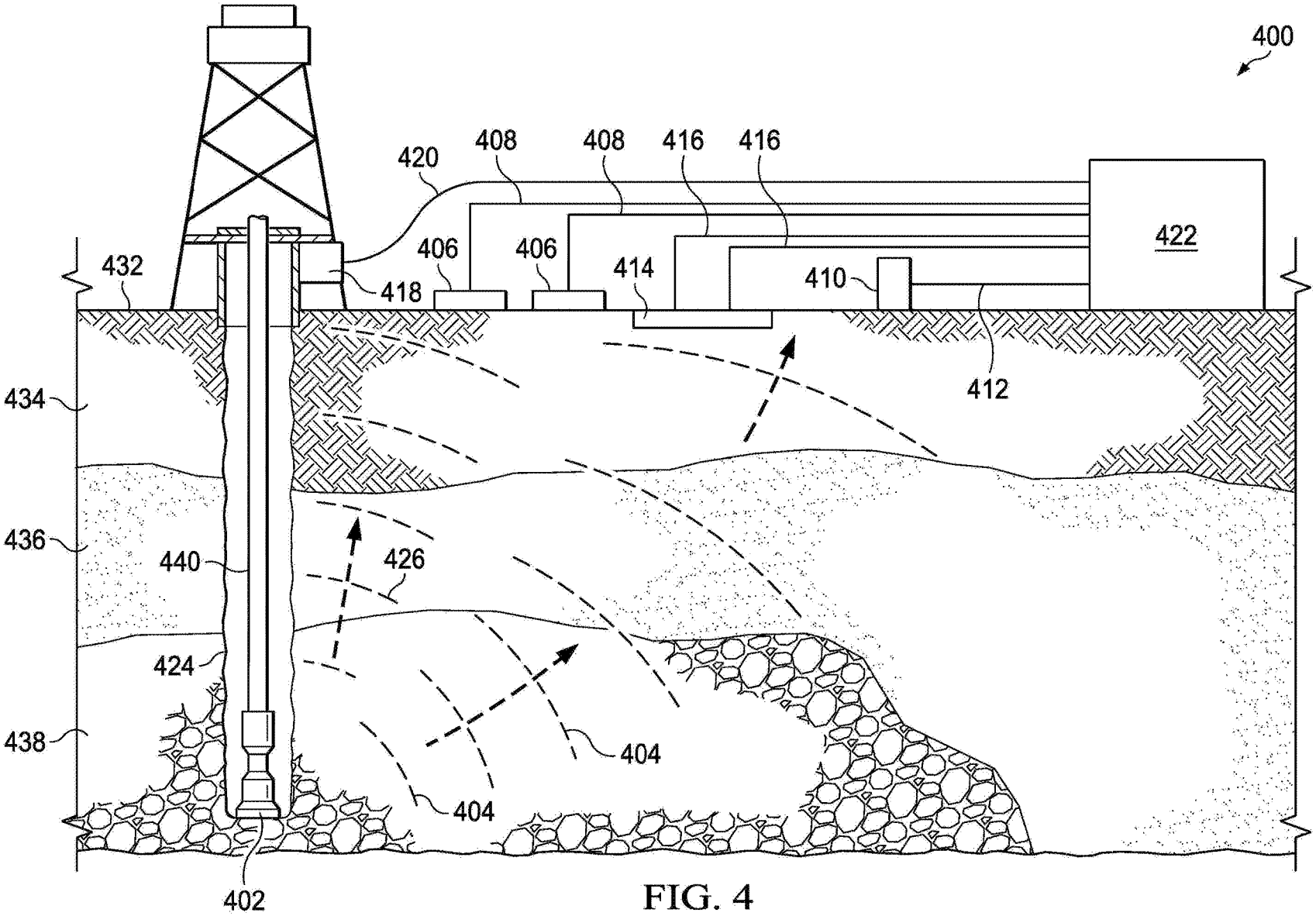
FIG. 4 is an elevation view of an exemplary measurement system associated with a pulsed drilling system.

FIG. 4 is an elevation view of an exemplary measurement system associated with a pulsed drilling system. Measurement system 400 may include sensor analysis system 422 that receives data from one or more of sensors 406, 410, 414 and 418 via one or more of interfaces 408, 412, 416, and 420. A pulsed-power drilling system may include pulsed-power drill bit 402 located at the distal end of wellbore 424. During pulsed drilling operations, electromagnetic waves 404 and acoustic waves 426 may be created by pulses generated at drill bit 402. Electromagnetic waves 404 may propagate through one or more subterranean layers 438, 436, 434 before reaching surface 432. Acoustic waves 426 may propagate uphole along wellbore 424 from drill bit 402 to surface 432 and travel through one or more subterranean layers 438, 436, 434. One or more of sensors 406, 410, 414 and 418 may be located in wellbore 424 and/or on surface 432. The sensors may be located a known distance from drill bit 402. The sensors may record responses to received signals including, but not limited to, high-energy electrical pulses, electrical arcs, or electromagnetic waves 404 and/or acoustic waves 426 created during pulsed drilling operations. The sensors may send one or more measurements representing the recorded responses recorded to sensor analysis system 422, which analyzes the measurement data. One or more components of sensor analysis system 422 may be located on surface 432, in wellbore 424, and/or at a remote location. For example, sensor analysis system 422 may include a measurement processing subsystem in wellbore 424 that processes measurements provided by one or more of the sensors and transmits the results of the processing uphole to another component of sensor analysis system 422 for storage and/or further processing.

During pulsed drilling operations, high-energy electrical pulses are applied to the electrodes of drill bit 402 to build up electric charge at the electrodes. The rock in the surrounding formation fractures when an electrical arc forms at drill bit 402. Electromagnetic waves 404 are created by the current associated with the electrical arc and/or the electric charge built up on the electrodes of drill bit 402. In addition, acoustic waves 426 are created by the electrical arc and subsequent fracturing of rock in the formation proximate to the drill bit.

The duration of an electrical arc created during a pulsed drilling operation may be approximately 100 μs. The duration of the electrical arc may be shorter than the duration of the high-energy electrical pulses that are applied to the electrodes of drill bit 402, which may repeat on the order of several to a few hundred hertz. Because the duration of the electrical arc is less than the repetition period of the pulses, electrical arcs that are generated at drill bit 402 may be represented by a series of impulses in which each impulse has a corresponding electromagnetic wave and acoustic wave. The time at which the impulse occurs may be used to measure, map, and/or image subterranean features. If the repetition period of the series of impulses is Ts, the Fourier transform of the impulses in the frequency domain consists of impulses occurring at multiples of a base frequency ($f_0$) equal to $2\,n\pi/Ts$. If drill bit 402 provides pulses at a constant frequency, a range of corresponding discrete frequencies (e.g., $f_0$, $2f_0$, $3f_0$) are generated in the frequency domain. The discrete frequencies may be used to measure, map, and/or image subterranean features.

Electromagnetic waves 404 and/or acoustic waves 426 originate from and/or in proximity to drill bit 402 at the distal end of wellbore 424 and propagate outward. For example, electromagnetic waves 404 and/or acoustic waves 426 may propagate through one or more of subterranean layers 438, 436, 434. A boundary defining the extent of an individual subterranean layer and/or defining a transition between two subterranean layers may be referred to as a bed boundary. Although FIG. 4 illustrates a formation having three layers, the subterranean formation may include any number of layers suitable for pulsed drilling. Electromagnetic waves 404 and/or acoustic waves 426 created at and/or in proximity to drill bit 402 may propagate from layer 438 to the surface 432 via layers 434 and/or 436. Although electromagnetic waves 404 and acoustic waves 426 waves are illustrated in FIG. 4 as propagating in certain directions, electromagnetic waves 404 and acoustic waves 426 may propagate in any direction.

Sensors 406, 410 and/or 414 record responses to received signals including, but not limited to, high-energy electrical pulses, electrical arcs, or electromagnetic and/or acoustic waves. Sensors 406, 410 and 414 may convert the recorded responses into measurements and send the measurements to sensor analysis system 422. The measurements may be digital representations of the recorded responses. Although three sensors are illustrated, measurement system 400 may include any number of sensors of any suitable type to detect, receive, and/or measure an electric and/or magnetic field. The sensors may include any type of sensor that records responses from electromagnetic and/or acoustic waves including, but not limited to, the sensors illustrated in FIGS. 7A-7F and described below.

Sensor 406 may be communicatively coupled via interface 408 to sensor analysis system 422, sensor 410 may be communicatively coupled via interface 412 to sensor analysis system 422, and sensor 414 may be communicatively coupled via interface 416 to sensor analysis system 422. Each sensor may provide differential or single-ended measurement data to sensor analysis system 422 via an interface. For example, sensor 406 is illustrated with interface 408 having two sub-interfaces to transmit differential measurement data to sensor analysis system 422.

Sensor analysis system 422 may receive measurements from one or more of sensors 406, 410 and 414, and store the measurements as a function of pulse index and time or frequency. The pulse index may begin at one and be incremented each time a new pulse is generated at drill bit 402 during a pulsed drilling operation. The measurements may be represented in the time domain or the frequency domain. In the time-domain, sensors 406, 410 and 414 may measure electromagnetic waves by determining a voltage or current and may measure acoustic waves by determining a pressure or displacement. In the frequency domain, a sensor may measure the amplitude and phase by recording responses to the received signal, such as a steady state monochromatic signal, or by performing a Fourier transform of the signal, such as a wide band signal.

Acoustic waves 426 originate at or near drill bit 402 and propagate uphole along wellbore 424 to surface 432 during a pulsed drilling operation. Sensor 418 may be located proximate to surface 432 and may record responses to the acoustic wave to provide measurements to sensor analysis system 422 via interface 420 such that sensor analysis system 422 may calculate the time at which the electrical arc is formed. Each acoustic wave may travel uphole to the surface along the casing of wellbore 424 and drill string 440 at a known velocity. For example, the acoustic wave travels at a velocity of approximately 5000 m/s if the casing and drill string 440 are formed of steel. Other materials suitable for pulsed drilling operations with known acoustic propagation velocities may be used for the casing and drill string 440. For example, the acoustic propagation velocity is between 50 and 2000 m/s for rubber, on the order of 6000 m/s for titanium, and on the order of 4000 m/s for iron. The time of the formation of the electrical arc may be determined based on the known propagation velocity of the material used to form the casing and drill string 440 and the distance between surface 432 and drill bit 402. The distance between drill bit 402 and surface 432 may be determined by depth and position information generated by known downhole survey techniques for vertical drilling, directional drilling, multilateral drilling, and/or horizontal drilling.

Although FIG. 4 illustrates one acoustic sensor at the surface, any number of acoustic sensors suitable to measure, map, and/or image subterranean features may be positioned at one or more locations on the surface or elsewhere. For example, an array of acoustic sensors may be used within the wellbore. The acoustic sensors in the array may be positioned at different locations within the wellbore, and may be oriented in different directions to record responses to propagating acoustic waves. The array may provide information about the surrounding formation at various depths sufficient for sensor analysis system 422 to form a three-dimensional image of the surrounding subterranean features.

The equipment shown in FIG. 4 may be land-based or non-land based equipment or tools that incorporate teachings of the present disclosure. For example, some or all of the equipment may be located on offshore platforms, drill ships, semi-submersibles, or drilling barges (not expressly shown). Additionally, while the wellbore is shown as being a generally vertical wellbore, the wellbore may be any orientation including generally horizontal, multilateral, or directional.

Sensor analysis system 422 may process measurements received from sensors 406, 410, 414 and/or 418 to determine characteristics of the surrounding formation and to generate predictions about the formation layers downhole from drill bit 402. For example, the sensor analysis techniques described herein may be used to detect and analyze geologic features considered to be drilling hazards. Detection of such hazards facilitate the use of more efficient drilling strategies or drilling directions which may, in turn, reduce the cost of the drilling process while increasing the rate of penetration (ROP). The data collected by various acoustic, electric or electromagnetics sensors or sensor arrays may be used to optimize the drilling process. For example, drilling speed, type of mud, BHA configuration (e.g., stabilizer positions) and/or other operating parameters may be modified to optimize a drilling process based on characteristics of the formation that are determined using the sensor data.

As described above, in pulsed-power drilling systems, the drill bit may be excited with a train of high-energy electrical pulses, which may or may not be uniform. The strength of the electric discharge will be different based on the properties of the formation over which the discharge occurs and the length of the discharge path. Reference electromagnetic and/or acoustic sensors positioned near the drill bit may record the strength of the waves produced by the pulsed drilling operation near the electrical arc. Measurements representing the responses recorded by the reference sensors may be used to normalize the responses measured by the additional sensors. A sensor analysis system may use a forward model to invert the measured responses to the formation parameters.

Figure 5:
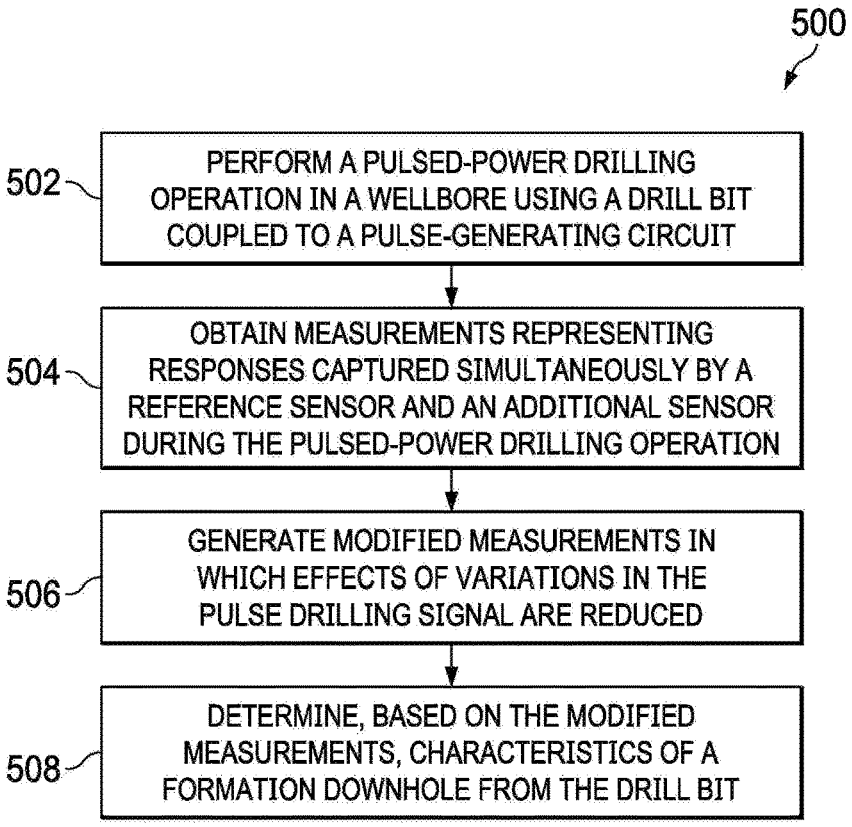
FIG. 5 is a flow chart illustrating an exemplary method for determining formation characteristics using reference sensor responses recorded during pulsed drilling operations.

FIG. 5 is a flow chart illustrating an exemplary method for determining formation characteristics using reference sensor responses recorded during pulsed drilling operations. Method 500 may include, at 502, performing a pulsed drilling operation in a wellbore using a drill bit coupled to a pulse-generating circuit. For example, drill bit 114 may be placed downhole in wellbore 116 as shown in FIG. 1. The drill bit may include a first electrode and a second electrode electrically coupled to the pulse-generating circuit to receive pulse drilling signals during pulsed drilling operations. The drilling system may also include at least one reference sensor positioned in proximity to the drill bit, and at least one additional sensor positioned uphole from the reference sensor(s). The additional sensor(s) may be positioned within drill string 108, may be positioned at a surface above the formation, or may be located in a wellbore other than the wellbore 116 in which the pulsed drilling operation is performed. Example arrangements of reference sensors and additional sensors are illustrated in FIGS. 7A-7F and described below.

At 504, measurements representing responses recorded simultaneously by a reference sensor and by an additional sensor during the pulsed drilling operation may be obtained. Each of the reference sensor and the additional sensor may include an acoustic sensor that records acoustic waves produced by the pulsed drilling operation, an electromagnetic sensor that records electromagnetic waves produced by the pulsed drilling operation, or both an acoustic sensor and an electromagnetic sensor. The additional sensor may include a distributed acoustic sensing (DAS) system, such as DAS subsystem 155 illustrated in FIG. 1 or DAS system 800 illustrated in FIG. 8. The sensors may provide signals or measurements representing voltages, currents, measurements of electric field strength, measurements of magnetic field strength, or any combinations thereof to a sensor analysis system, such as sensor analysis system 150 illustrated in FIG. 1 or sensor analysis system 900 illustrated in FIG. 9, for analysis and/or for storage and subsequent processing. Reference sensors located near the drill bit may record the strength of the waves produced by the pulsed drilling operation near the electrical arc. Measurements representing the responses recorded by the one or more reference sensors may be used to normalize the measurements representing responses recorded by additional sensors farther from the drill bit.

At 506, modified measurements may be generated in which effects of variations in the pulse drilling signal are reduced. For example, the effects of variations in the pulse drilling signal on the measurements representing responses recorded by the additional sensor may be reduced based on the measurements representing responses recorded by the reference sensor. The modified measurements may be generated by the sensor analysis system or may be generated by the sensor analysis system in combination with one or more of the sensors. For example, a sensor or sensor array include an analog-to-digital converter that converts the signals recorded by a sensor into measurements in a form suitable for analysis by the sensor analysis system. The sensor analysis system may calculate an adjustment to be applied to the measurements representing responses recorded by the additional sensor based on the measurements representing responses recorded by the reference sensor to normalize or otherwise modify the measurements to reduce the effects of variations in the pulse drilling signal. The modified measurements may be analyzed by the sensor analysis system to determine formation characteristics ahead of the drill bit.

An operation to reduce the effects of variations in the pulse drilling signals on the measurements may include converting the signals recorded by the sensors, or digitized versions thereof, to the frequency domain and operating on the converted signals in the frequency domain. In one example, an operation to reduce the effects of variations in the pulse drilling signal may include converting a first signal recorded by the additional sensor to the frequency domain, converting a second signal recorded by the reference sensor to the frequency domain, and determining, in the frequency domain, a modified measurement representing a ratio of the first signal to the second signal. In another example, an operation to reduce the effects of variations in the pulse drilling signal may include converting a first signal recorded by the additional sensor to the frequency domain, converting a second signal recorded by the reference sensor to the frequency domain, generating a modified second signal by multiplying, in the frequency domain, the second signal by a constant, and determining a modified measurement by subtracting, in the frequency domain, the modified second signal from the first signal. Any suitable technique for reducing the effects of variations in the pulse drilling signal on the measurements representing responses recorded by the additional sensor are reduced based on the measurements representing responses recorded by the reference sensor may be used in the pulsed-power drilling system to improve the results of the analysis performed by the sensor analysis system.

At 508, a characteristic of a formation downhole from the drill bit may be determined based on the modified measurements. The determined characteristic of the formation may include at least one of density d, shear velocity Vs, compressed velocity Vc, and Young's modulus, electrical conductivity $\sigma$, dielectric permeability and magnetic permeability $\mu$. The determined characteristic may be a characteristic of a first layer of the formation downhole from the drill bit that is different from a characteristic of a second layer of the formation, and the sensor analysis system may be configured to determine a position, with respect to the drill bit, of a transition between the second layer of the formation and the first layer of the formation.

Determining a characteristic of the formation may include the sensor analysis system performing an acoustic inversion based on the recorded acoustic waves, performing an electromagnetic inversion based on the recorded electromagnetic waves, or performing both an acoustic inversion and an electromagnetic inversion, either in series or as a joint inversion. The inversion may use unmodified measurements representing responses received from various acoustic, electrical or electromagnetic sensors, measurements that have been normalized or otherwise modified based on reference sensor responses, or any combination of unmodified and modified measurements representing responses recorded by reference sensors and/or additional sensors. An example inversion process is illustrated in FIG. 6 and described below.

Modifications, additions, or omissions may be made to method 500 without departing from the scope of the disclosure. For example, the order of the steps may be performed in a different manner than that described and some steps may be performed at the same time. Additionally, each individual step may include additional steps without departing from the scope of the present disclosure.

Responses recorded by acoustic, electrical and electromagnetic sensors within or associated with a pulsed-power drilling system may be used as recorded or may be processed to generate differential responses to be used in determining characteristics of the formation downhole of a drilling tool. One example method for obtaining differential responses includes subtracting the sensor responses from each of the other responses in the complex voltage domain, or using a logarithm of the complex voltage domain. A second example method for obtaining differential responses may include calculating the differences between pairs of responses recorded by each sensor at two different positions, through subtraction, as the tool advances through the formation layers. A third example method for obtaining differential responses may include a combination of the first and second example methods such that differences are calculated, through subtraction, between the differential responses generated for each pair of sensors at two different positions. The differential responses provided by any of these methods may be then processed using one or more inversion techniques that are designed to operate based on differential responses.

Figure 6:
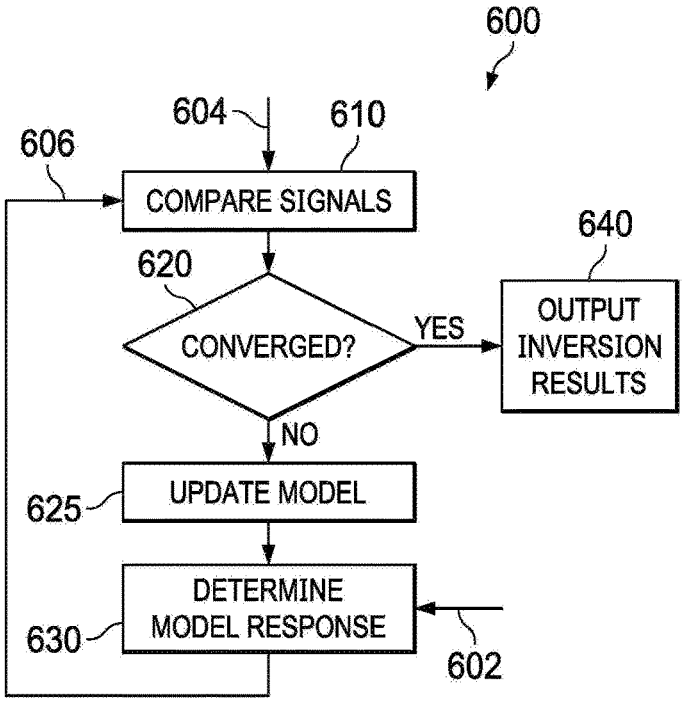
FIG. 6 is a flow chart illustrating an exemplary inversion process.

FIG. 6 is a flow chart illustrating an exemplary inversion process. The inversion may be performed by a sensor analysis system associated with a pulsed-power drilling system such as sensor analysis system 150 illustrated in FIG. 1 or sensor analysis system 900 illustrated in FIG. 9. In this example, inputs to inversion process 600 include model generation inputs 602 and received signals 604. Model generation inputs 602 may include initial estimates of various characteristics of a formation, such as an assumption about the type of rock located ahead of the drill bit. Model generation inputs 602 may be used to determine a model response, as shown in 630, including various model parameters and estimated signals 606. For example, the model response may include electrical and/or acoustic properties associated with the estimated type of rock. Estimated signals 606 may include estimates of the characteristics of the formation, as determined by the inversion process. Received signals 604 include any combination of unmodified measurements representing responses recorded by various acoustic, electrical or electromagnetic sensors and/or measurements derived from raw information recorded by the sensors, for example, responses that have been normalized or otherwise modified based on reference sensor responses, as described above with respect to FIG. 5. Received signals may include one or more measurements, such as a voltage, a current, ratio of a voltage to a current, an electrical field strength, or a magnetic field strength of the electromagnetic and/or acoustic waves created during pulsed drilling operations. The characteristic may represent a value in the time or frequency domain. In the frequency domain, for example, absolute values of received signals 604 may be used at discrete frequencies. As another example, the ratios of received signals 604 at different frequencies may be used in the inversion. The ratio of received signals 604 may reduce or filter out any undesirable factor in received signals 604, such as the borehole effect or amplitude and/or phase fluctuations in the excitation of the electrical pulse or electric arc. The inversion may consider the ratio of received signals 604 at different frequencies to be one received signal at one frequency.

As shown at 610, received signals 604 may be compared with estimated signals 606 to determine whether there is a mismatch between received signals 604 and estimated signals 606. If there is a mismatch between the signals, rather than a convergence, the model parameters may be updated, as shown in 625, and an updated model response may be determined, as shown in 630. For example, if the electrical and/or acoustic properties of the formation indicated by received signals 604 do not match the electrical and/or acoustic properties of the model response, which are associated with the estimated type of rock, the model response may be updated to reflect that the estimate of the type of rock located ahead of the drill bit has changed. When and if there is convergence between received signals 604 and estimated signals 606, the results of the inversion process may be output, as shown in 640. For example, if a match is found between a model response for an estimated type of rock and received signals 604, formation characteristics of the estimated type of rock may be output as formation characteristics of the rock located ahead of the drill bit.

As described above, performing the inversion may include performing an acoustic inversion based on recorded or modified responses to acoustic waves, performing an electromagnetic inversion based on recorded or modified responses to electromagnetic waves, or performing both an acoustic inversion and an electromagnetic inversion, either in series or as a joint inversion. For example, both electromagnetic and acoustic data may be input to a joint electromagnetic/acoustic inversion that determines at least one of formation resistivity, formation dielectric constant, formation magnetic permeability, formation resistivity anisotropy, layer positions, formation density, formation compressional velocity and formation shear velocity. Each of these properties may vary as a function of depth and/or radius away from the center of the wellbore. The inversion may be based on an electromagnetic and acoustic simulation model that relates the electromagnetic properties of the formation to electromagnetic data, and relates the acoustic properties of the formation to acoustic data. Certain formation properties, such as layer positions, may be shared between the acoustic and electromagnetic inversions. The electromagnetic and acoustic formation property models may be related to each other based on petrophysical relationships between various electromagnetic and acoustic properties of particular formations.

In another example, an electromagnetic inversion may be conducted first, and then an acoustic inversion may be conducted. In the acoustic inversion, certain constraints may be applied based on the results of the electromagnetic inversion. For example, an electromagnetic inversion may be used to determine layer positions within the formation, and these positions may be used as an input to the acoustic inversion. In another example, an electromagnetic inversion may be used to calculate a wellbore diameter, and this wellbore diameter may be used to constrain or fix the wellbore diameter for the acoustic inversion. In another example, a resistivity anisotropy ratio, which is the ratio of horizontal resistivity to vertical resistivity, may be calculated from an electromagnetic inversion, and the resistivity anisotropy ratio may be input to an acoustic inversion as an estimate for the acoustic anisotropy ratio, which represents a directional variation in the velocity of an acoustic signal. In yet another example, layers of interest may be determined from the electromagnetic inversion, and only those layers may be inverted in the acoustic inversion.

In another example embodiment, an acoustic inversion may be conducted first and then an electromagnetic inversion may be conducted. In the electromagnetic inversion, certain constraints may be applied based on the results of the acoustic inversion. For example, an invasion depth may be calculated using radial profiling processing and the invasion depth may be used in the electromagnetic inversion to constrain the position of invasion depth. In another example, distance to a layer boundary may be recovered using an acoustic inversion, and the boundary distance may be input to the electromagnetic inversion as a constraint or as a fixed parameter.

A pulsed-power drilling system may include any number of receiving sensors, or arrays of receiving sensors, that are positioned at one or more locations uphole from at least one reference sensor. The reference sensor may be located in the drill string near the drill bit. The drill string may include an isolator positioned to block pulse drilling signals from travelling along the drill string toward the reference sensor and the additional sensor.

As described above in reference to FIG. 4, additional electromagnetic and acoustic sources may be positioned proximate to the drilling tip to effect larger excitation of the electromagnetic and acoustic waves generated by the electrical arc and enhance the signal-to-noise ratio for the data recorded by the electromagnetic and acoustic sensor arrays. When an array of sensors is positioned at the surface above a formation, the sensors of the array may be arranged in a two-dimensional grid or in any other suitable configuration. A single receiving sensor at the surface may be used to record multiple responses to the electromagnetic and acoustic waves produced by a pulsed drilling operation at different positions by repositioning the sensor between measurements. A single receiving sensor within the drilling tool may be used to record multiple responses to the electromagnetic and acoustic waves produced by a pulsed drilling operation at different positions by rotating the drilling tool, or the portion of the drilling tool that includes the single receiving sensor, during operation.

FIGS. 7A through 7F are elevation views of exemplary downhole pulsed-power drilling systems for determining formation characteristics using reference sensor responses recorded during pulsed drilling operations. Each of these systems includes pulse drilling tool 710 for implementing a pulsed drilling process. Pulse drilling tool 710 is shown within a wellbore 704 as a pulsed drilling operation is being performed. Drilling tool 710 includes a reference sensor 712 near the downhole end of the drilling tool and one or more additional acoustic and/or electromagnetic sensors uphole from the drilling tool for recording electromagnetic and acoustic waves 718 produced by the pulse drilling tool.

Figure 7A:
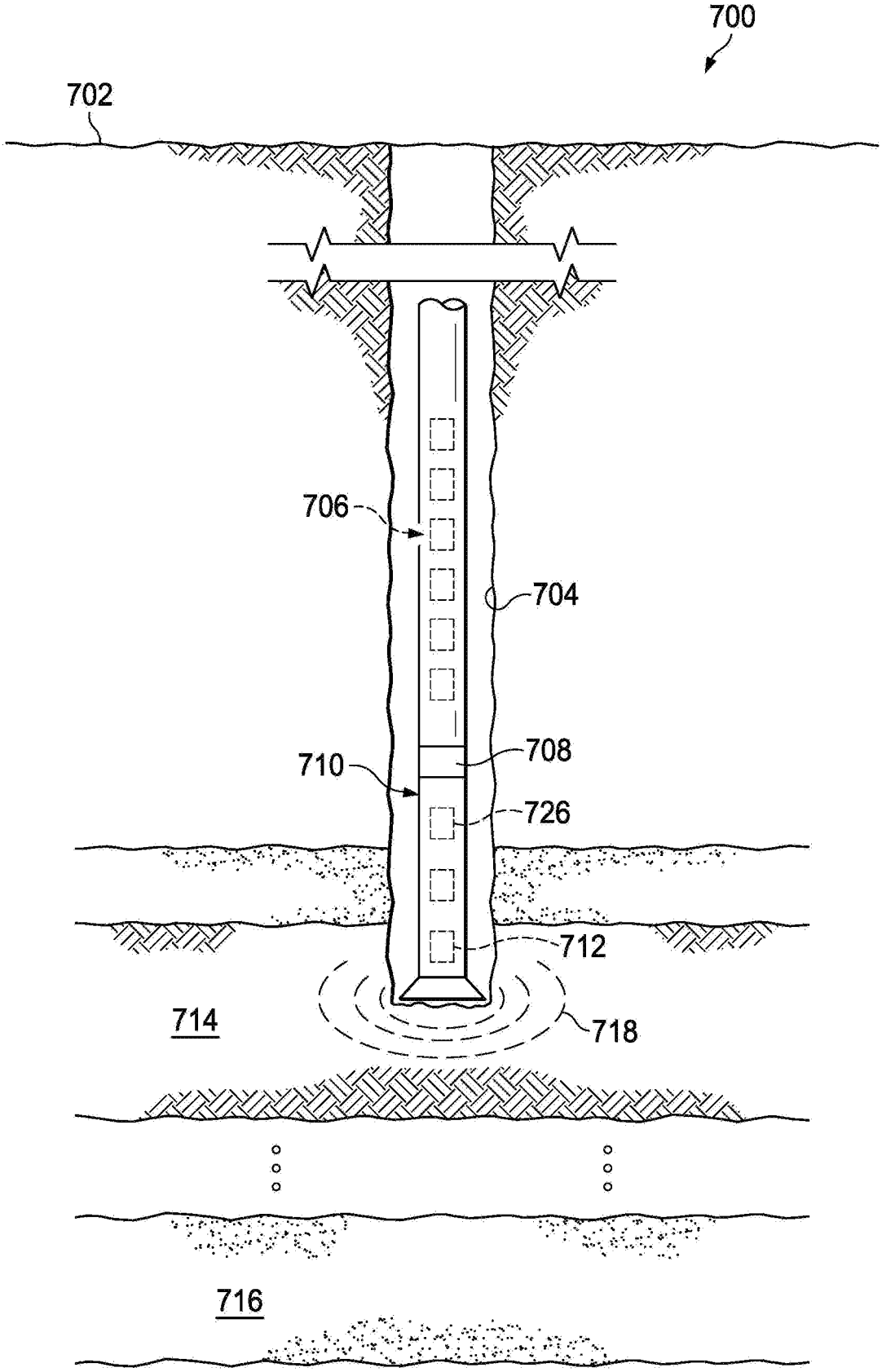
FIG. 7A is an elevation view of an exemplary pulsed-power drilling system for determining formation characteristics using reference sensor responses recorded during pulsed drilling operations.

FIG. 7A illustrates an example embodiment in which a drilling system 700 includes a drilling tool 710 performing a pulsed drilling operation within a formation below surface 702 that includes n subterranean layers, including a first subterranean layer 714 and an $n^{th}$ subterranean layer 716. The system includes an electromagnetic/acoustic sensor array 706 in which the sensors are distributed within drilling tool 710, and additional electromagnetic/acoustic sources 726 within drilling tool 710. The system also includes an electromagnetic/acoustic insulator 708 positioned to block pulse drilling signals from travelling along the drill string toward sensor array 706.

Figure 7B:
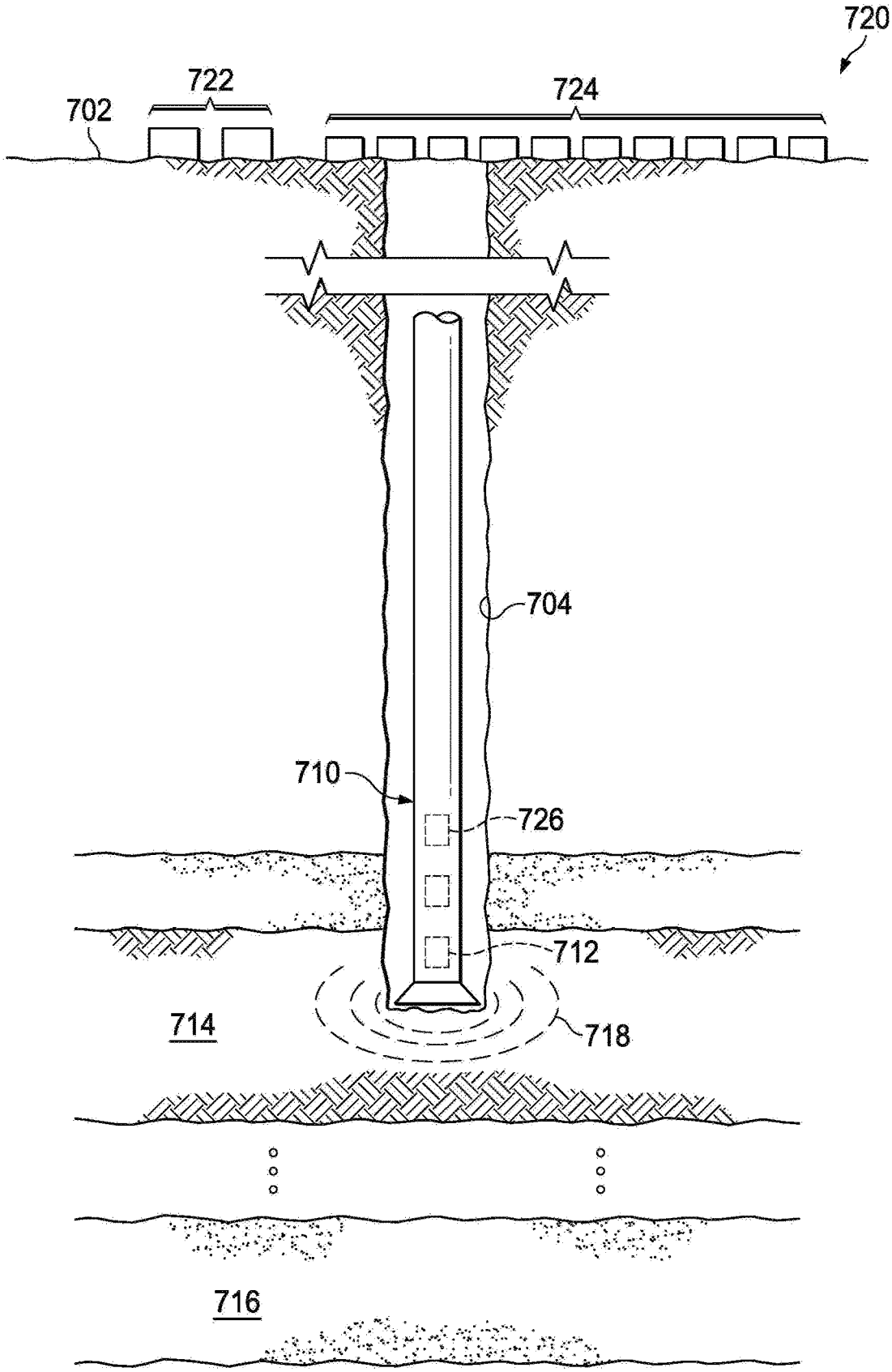
FIG. 7B is an elevation view of an exemplary pulsed-power drilling system for determining formation characteristics using reference sensor responses recorded during pulsed drilling operations.

FIG. 7B illustrates an example embodiment in which a drilling system 720 includes a drilling tool 710 performing a pulsed drilling operation within a formation below surface 702 that includes n subterranean layers, including a first subterranean layer 714 and an $n^{th}$ subterranean layer 716. The system includes an electromagnetic/acoustic sensor array 724 in which the sensors are distributed on the surface 702. The system also includes electromagnetic/acoustic sources 726 within drilling tool 710 and electromagnetic/acoustic sources 722 on the surface 702.

Figure 7C:
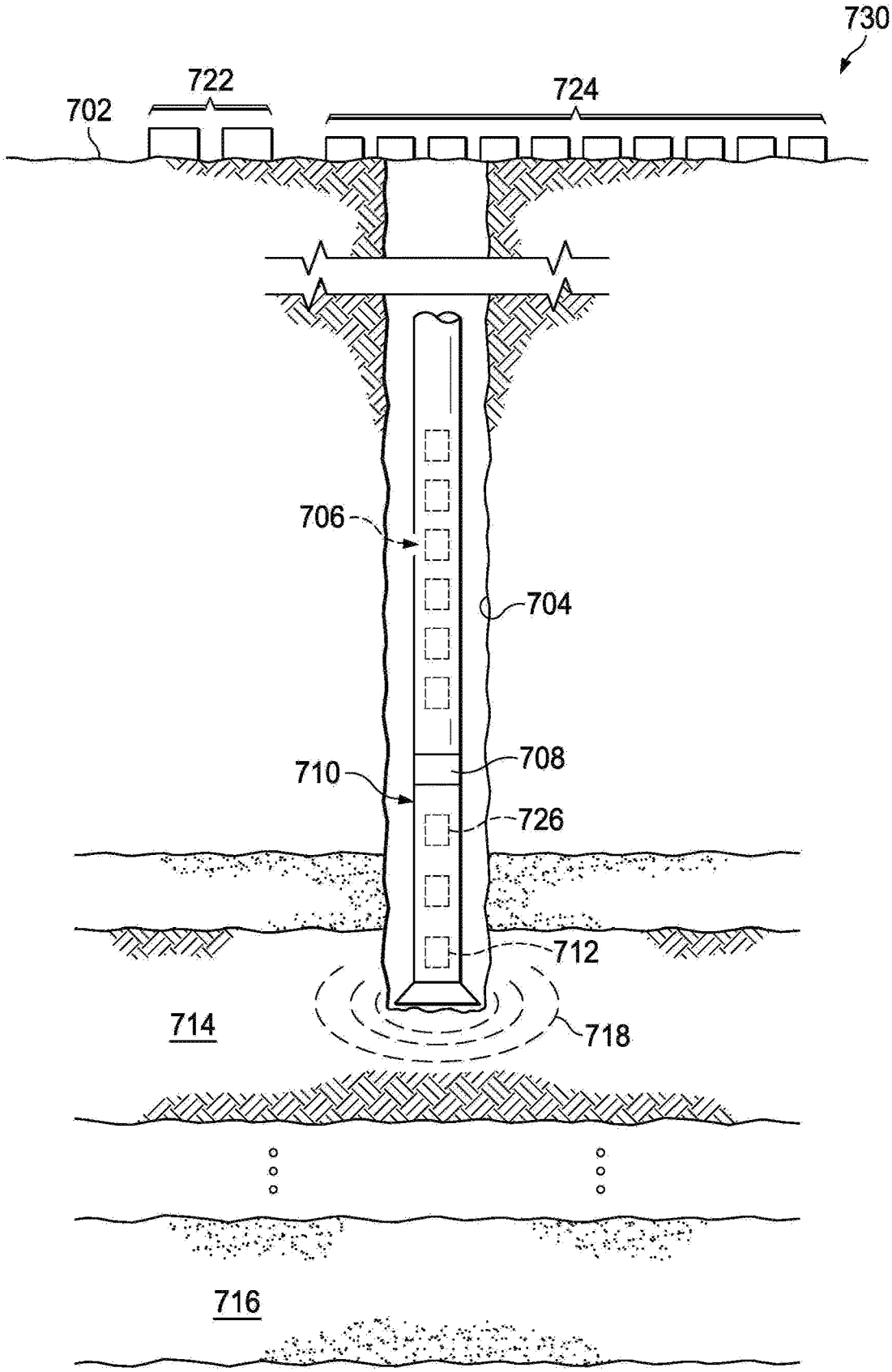
FIG. 7C is an elevation view of an exemplary pulsed-power drilling system for determining formation characteristics using reference sensor responses recorded during pulsed drilling operations.

FIG. 7C illustrates an example embodiment in which a drilling system 730 includes a drilling tool 710 performing a pulsed drilling operation within a formation below surface 702 that includes n subterranean layers, including a first subterranean layer 714 and an $n^{th}$ subterranean layer 716. The system includes an electromagnetic/acoustic sensor array 724 in which the sensors are distributed on the surface 702 and an electromagnetic/acoustic sensor array 706 in which the sensors are distributed within drilling tool 710. The system includes electromagnetic/acoustic sources 726 within drilling tool 710 and electromagnetic/acoustic sources 722 on the surface 702. The system also includes an electromagnetic/acoustic insulator 708 positioned to block pulse drilling signals from travelling along the drill string toward sensor array 706.

Figure 7D:
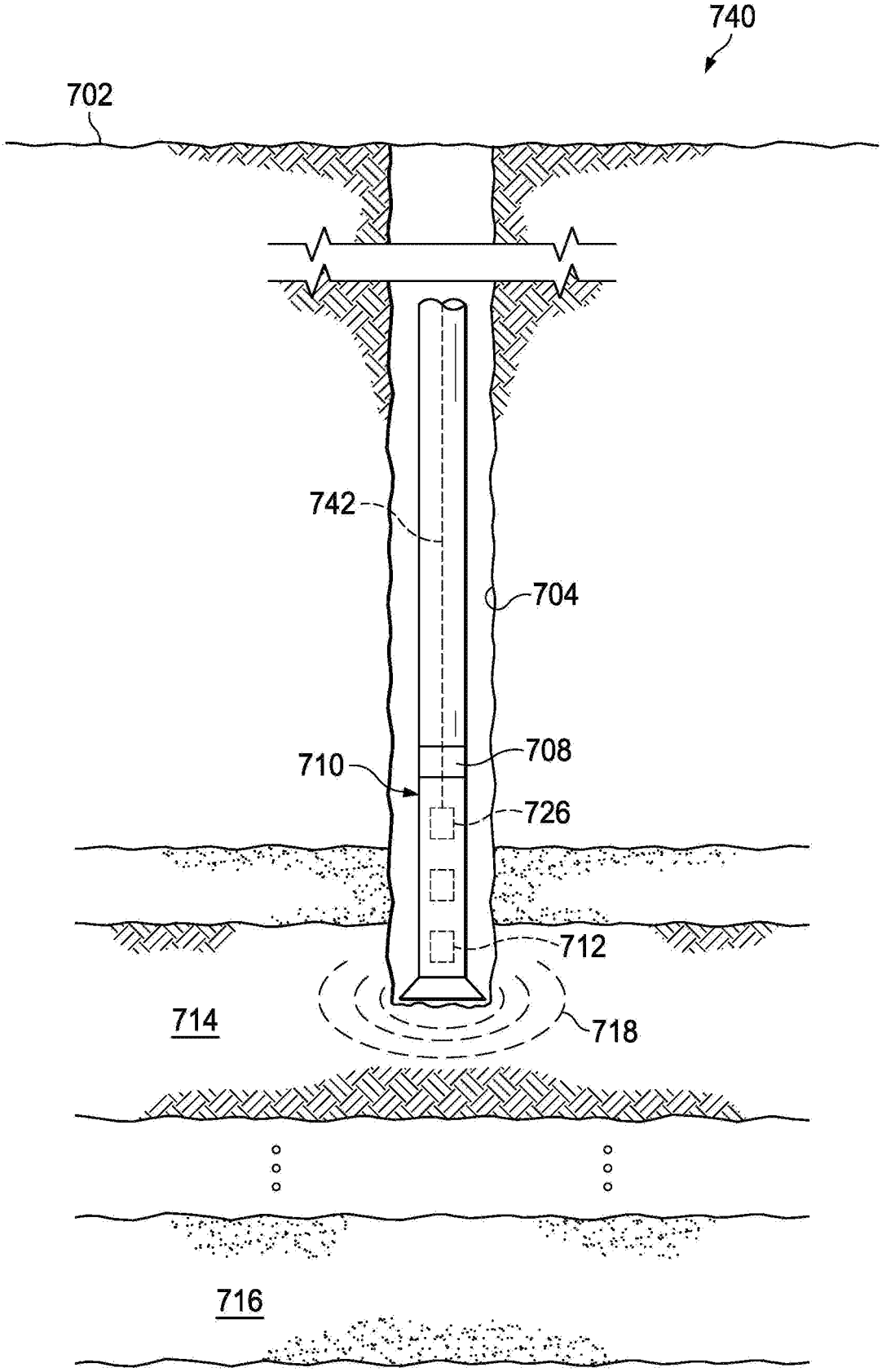
FIG. 7D is an elevation view of an exemplary pulsed-power drilling system for determining formation characteristics using reference sensor responses recorded during pulsed drilling operations.

FIG. 7D illustrates an example embodiment in which drilling system 740 includes a drilling tool 710 performing a pulsed drilling operation within a formation below surface 702 that includes n subterranean layers, including a first subterranean layer 714 and an $n^{th}$ subterranean layer 716. The system includes an electromagnetic/acoustic sensor array that is implemented using an optical fiber 742 of a distributed acoustic sensing (DAS) system, such as DAS system 800 illustrated in FIG. 8. The system includes additional electromagnetic/acoustic sources 726 within drilling tool 710. The system also includes an electromagnetic/acoustic insulator 708 positioned to block pulse drilling signals from travelling along the drill string toward the DAS fiber 742.

Figure 7E:
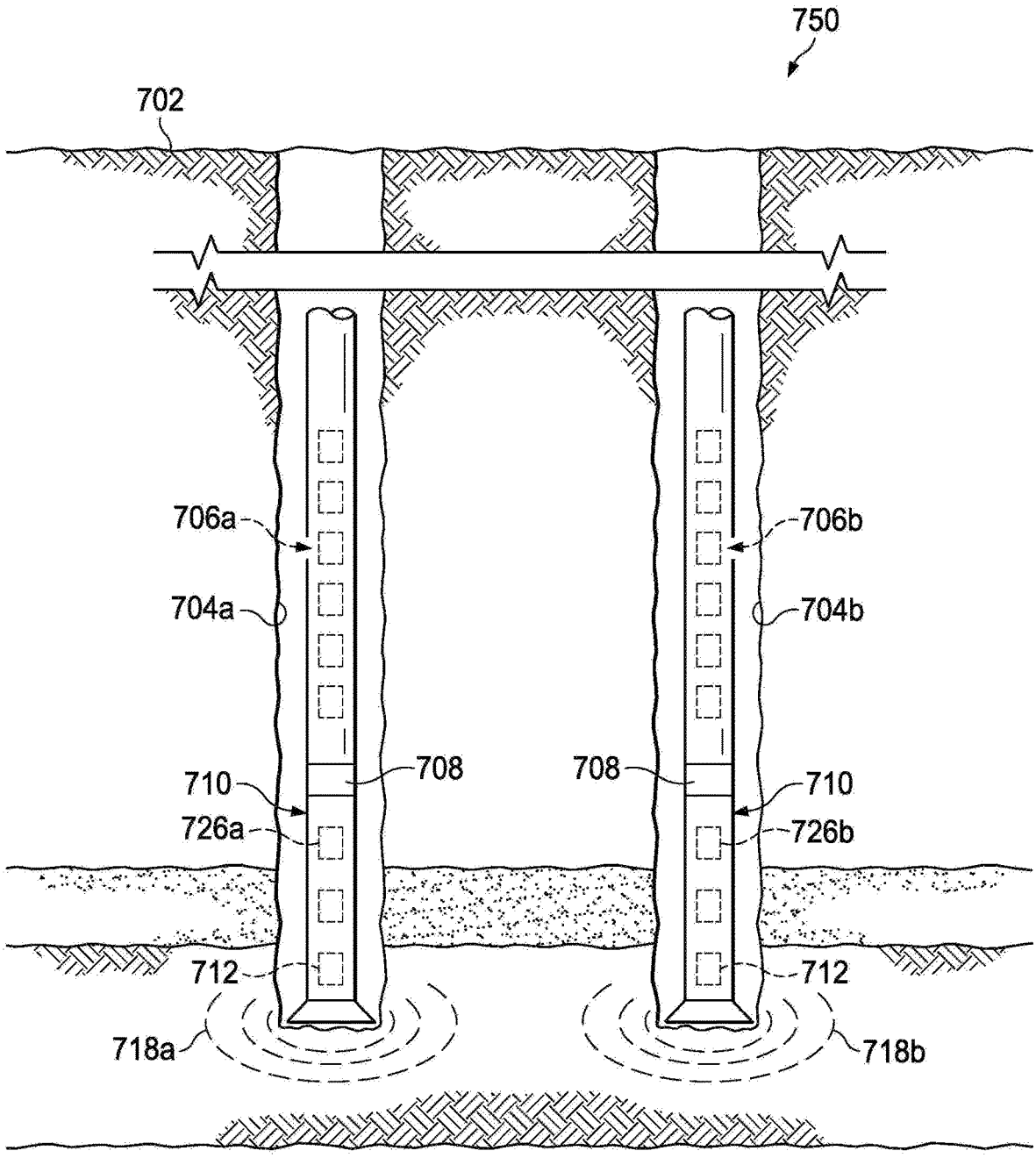
FIG. 7E is an elevation view of an exemplary pulsed-power drilling system for determining formation characteristics using reference sensor responses recorded during pulsed drilling operations.

FIG. 7E illustrates an example embodiment in which cross-hole imaging may be performed. In this example embodiment, drilling system 750 includes two drilling tools 710 performing pulsed drilling operations in respective wellbores 704 within a formation below surface 702. The wellbores may be separated by several hundreds or thousands of feet. Each drilling tool 710 includes a reference sensor 712, an electromagnetic/acoustic sensor array 706 in which the sensors are distributed within drilling tool 710, additional electromagnetic/acoustic sources 726, and an electromagnetic/acoustic insulator 708 positioned to block pulse drilling signals from travelling along the drill string toward sensor array 706. In this example, sensor array 706*a* may record responses to electromagnetic and acoustic waves 718*a* produced by the pulse drilling tool 710 within wellbore 704*a* and may also record responses to electromagnetic and acoustic waves 718*b* produced by the pulse drilling tool 710 within wellbore 704*b*. Similarly, sensor array 706*b* may record responses to electromagnetic and acoustic waves 718*b* produced by the pulse drilling tool 710 within wellbore 704*b* and may also record responses to electromagnetic and acoustic waves 718*a* produced by the pulse drilling tool 710 within wellbore 704*a*.

Figure 7F:
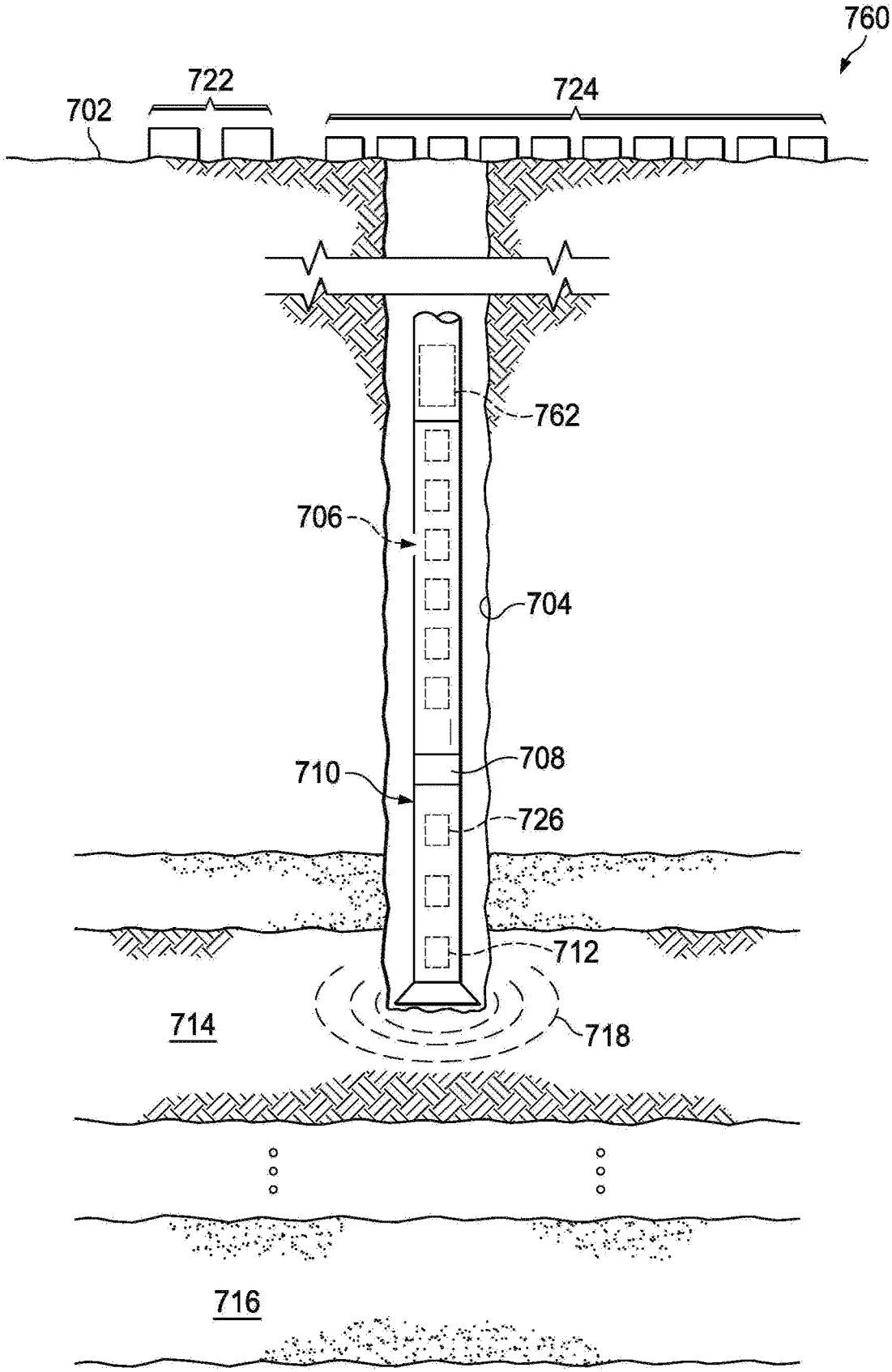
FIG. 7F is an elevation view of an exemplary pulsed-power drilling system for determining formation characteristics using reference sensor responses recorded during pulsed drilling operations.

FIG. 7F illustrates an example in which a drilling system 700 includes a drilling tool 710 performing a pulsed drilling operation within a formation below surface 702 that includes n subterranean layers, including a first subterranean layer 714 and an $n^{th}$ subterranean layer 716. The system includes an electromagnetic/acoustic sensor array 706 in which the sensors are distributed within drilling tool 710, and additional electromagnetic/acoustic sources 726 within drilling tool 710. The system includes an electromagnetic/acoustic insulator 708 positioned to block pulse drilling signals from travelling along the drill string toward sensor array 706. The system also includes an ultra-deep reading tool 762 within the drill string to provide layering information in a range near the bottom-hole assembly of drilling tool 710. The ultra-deep reading tool 762 may be used in combination with sensor array 706 to determine various characteristics of the formation.

FIG. 8 is a block diagram of an exemplary distributed acoustic sensing (DAS) subsystem used to collect and analyze data from acoustic sensors. Acoustic sensing based on DAS may use the Rayleigh backscatter property of an optical fiber and may spatially detect disturbances that are distributed along the length of the optical fiber. A DAS subsystem may also detect reflections from fiber Bragg gratings (FBGs) or fiber optic partial mirrors added to a fiber optic cable. Such systems may rely on detecting phase changes brought about by changes in strain (e.g., caused by acoustic waves) along the length of an optical fiber. Externally-generated acoustic disturbances may create very small strain changes, which translate into phase changes of the reflected light along the optical fiber. The phase changes may be measured by taking measurements of light signals from two different points along the fiber in order to determine an average amount of strain over that distance.

DAS subsystem 800 may be positioned at the surface for use with pulsed-power drilling system 100 as illustrated in FIG. 1, or at any other suitable location. DAS subsystem 800 may be coupled to an optical fiber 818 that is positioned within a portion of the pulsed-power drilling system 100. For example, optical fiber 818 may be positioned within a wellbore, for example wellbore 116 illustrated in FIG. 1. Any suitable number of DAS subsystems (each coupled to an optical fiber 818 located downhole) may be placed inside or adjacent to wellbore 116. With optical fiber 818 positioned inside a portion of wellbore 116, DAS subsystem 800 may determine information associated with formation 118 based on changes in strain caused by acoustic waves. DAS subsystem 800 may be configured to transmit optical pulses into optical fiber 818, and to receive and analyze reflections of the optical pulse to detect changes in strain caused by acoustic waves.

DAS subsystem 800 may include interrogation controller 802 that directs various components of DAS subsystem 800 to perform distributed acoustic sensing. Interrogation controller 802 may include processor 804, memory 806, and storage 808, communicatively coupled to one another. Interrogation controller 802 may also be communicatively coupled to light source 810, reflection receiver 812, and output 816. In some embodiments, interrogation controller 802 may be configured to direct light source 810, reflection receiver 812 and/or output 816 to perform tasks associated with distributed acoustic sensing. Light source 810 may generate interrogating optical pulses using light from a laser.

Within interrogation controller 802, processor 804 may process instructions (e.g., from memory 806 and/or storage 808) and perform calculations associated with the distributed acoustic sensing. Processor 804 may include a microprocessor, microcontroller, digital signal processor (DSP), application specific integrated circuit (ASIC), or any other digital or analog circuitry configured to interpret and/or execute program instructions and/or process data. Processor 804 may be configured to interpret and/or execute program instructions and/or data stored in memory 806 to carry out distributed acoustic sensing. For example, program instructions stored in memory 806 may constitute portions of software for using time-domain reflectometry and/or frequency-domain reflectometry to detect information about formation 118 based on detected changes in strain on fiber optic cable 818 caused by acoustic waves.

Also within interrogation controller 802, memory 806 may store data and instructions used by processor 804 in carrying out the distributed acoustic sensing. As such, memory 806 may include any system, device, or apparatus configured to hold and/or house one or more memory modules. For example, memory 806 may include read-only memory, random access memory, solid state memory, or disk-based memory. Each memory module may include any system, device, or apparatus configured to retain program instructions and/or data for a period of time (e.g., computer-readable non-transitory media).

Also within interrogation controller 802, storage unit 808 may provide and/or store data and instructions used by processor 804 to perform the distributed acoustic sensing. In particular, storage unit 808 may store data that may be loaded into memory 806 during operation. Storage unit 808 may be implemented in any suitable manner, such as by functions, instructions, logic, or code, and may be stored in, for example, a relational database, file, application programming interface, library, shared library, record, data structure, service, software-as-service, or any other suitable mechanism. Storage unit 808 may store and/or specify any suitable parameters that may be used to perform distributed acoustic sensing. For example, storage unit 808 may provide information used to direct components of DAS subsystem 800 to transmit optical pulses, receive reflections from the optical pulses, and/or analyze the reflections to detect information about formation 118 based on detected changes in strain on fiber optic cable 818 caused by acoustic waves. Storage unit 808 may provide information used to transmit optical pulses with suitable timing, such as timing the optical pulses to be transmitted close to one another but not so close that reflections from the optical pulses overlap. Information stored in storage unit 808 may also facilitate correlating reflections received with particular times and corresponding physical locations, and analyzing reflections to detect changes in strain on fiber optic cable 818 caused by acoustic waves and resolve the locations at which acoustic waves are affected by particular characteristics of formation 118. Storage unit 808 may also be used to log and/or store information about optical pulses transmitted, reflections received, and/or information derived from analyzing the reflections for later use or further analysis.

As shown, output 816 may be configured to convey information determined by interrogation controller 802 to onsite and/or offsite operators associated with ongoing operations at the well system. For example, output 816 may be communicatively coupled to interrogation controller 802 and may include one or more display consoles or output logs configured to display information about formation 118 based on detected changes in strain on fiber optic cable 818 caused by acoustic waves. Specifically, output 816 may display or otherwise provide information such as a characteristic of formation 118, a location at which acoustic waves are affected by a particular characteristic of formation 118 or other information gleaned by interrogation controller 802 based on its analysis.

DAS subsystem 800 may also include light source 810. Light source 810 may be any component configured to generate and/or condition an optical pulse for distributed acoustic sensing. For example, light source 810 may include, without limitation, a laser source (e.g., a coherent laser source) that generates the optical pulse, a semiconductor optical amplifier that switches the laser source, a booster amplifier such as an erbium doped fiber amplifier (EDFA) that increases the maximum power of the optical pulse, and/or one or more active or passive filters that narrow and otherwise condition the optical pulse.

DAS subsystem 800 may also include a reflection receiver 812. Reflection receiver 812 may be any component configured to receive optical reflections (e.g., Rayleigh backscatter) and/or convert the optical reflections into analog or digital electrical signals that may be analyzed by interrogation controller 802. For example, reflection receiver 812 may include a photodiode configured to convert light from received reflections into an electrical signal. Reflection receiver 812 may also perform signal conditioning on the optical reflections and/or on the converted electrical signal. For example, reflection receiver 812 may include one or more filtering components configured to filter certain sidebands to decrease noise and narrow in on an information-carrying signal at a central frequency of the reflections. In this way, reflection receiver 812 may attempt to increase a signal-to-noise ratio, which may facilitate the analysis of the reflections to detect information about formation 118 based on detected changes in strain on fiber optic cable 818 caused by acoustic waves.

DAS subsystem 800 may also include power circulator 814. Power circulator 814 may be any suitable component that simultaneously transmits optical energy into an optical fiber while receiving optical energy from the optical fiber. Power circulator 814 may thus be configured to operate as a "roundabout" for optical energy going into and coming out of optical fiber 818. Power circulator 814 may receive optical energy such as an optical pulse from light source 810 and transmit the energy into optical fiber 818. Power circulator 814 may also receive optical energy such as reflections of the optical pulse from optical fiber 818 and deliver the reflected energy to reflection receiver 812. Power circulator 814 may be coupled with the uphole end of optical fiber 818 at bulkhead connector 820 and may transmit and receive optical energy through bulkhead connector 820.

In operation, DAS subsystem 800 may perform distributed acoustic sensing on optical fiber 818 to detect information about a formation based on detected changes in strain on fiber optic cable 818 caused by acoustic waves. Specifically, interrogation controller 802 may direct light source 810 to generate an optical pulse. The optical pulse may be transmitted into optical fiber 818 via power circulator 814 and bulkhead connector 820. Transient acoustic signatures based on acoustic waves produced by a pulsed drilling operation may cause reflections of the optical pulse to be generated as the optical pulse is transmitted through optical fiber 818. Reflection receiver 812 may receive the reflections via power circulator 814 and may convert the optical energy of the reflections into an electrical signal that may be processed by interrogation controller 802. Interrogation controller 802 may analyze the signal indicative of the received reflections using time-domain reflectometry, frequency-domain reflectometry, or other methodologies to detect information from the optical pulse. Accordingly, interrogation controller 802 may derive information detect information about the formation based on detected changes in strain on fiber optic cable 818 caused by acoustic waves and display the information to human operators using output 816.

The elements shown in FIG. 8 are exemplary only and DAS subsystem 800 may include fewer or additional elements in other embodiments. Modifications, additions, or omissions may be made to DAS subsystem 800 without departing from the scope of the present disclosure. For example, DAS subsystem 800 illustrates one particular configuration of components, but any suitable configuration of components may be used. Components of DAS subsystem 800 may be implemented either as physical or logical components. Furthermore, in some embodiments, functionality associated with components of DAS subsystem 800 may be implemented with special and/or general purpose circuits or components. Components of DAS subsystem 800 may also be implemented by computer program instructions.

The formation layer properties estimated using the techniques described herein based on the electromagnetic sensor data may include, without limitation, electrical conductivity $\sigma$, dielectric permeability $\varepsilon$ and magnetic permeability $\mu$. The formation layer properties estimated based on the acoustic sensor data may include, without limitation, density d, shear velocity Vs, compressed velocity Vc, and Young's modulus. In addition to the formation properties, a position for each layer may be determined based on the electromagnetic and/or acoustic sensor data. The distributions and positions of layers within the formation may be determined based on the spatial distribution of these estimated properties.

The data collected by acoustic, electrical or electromagnetic sensors may be processed using any of a variety of methods to estimate the positions, electrical properties and acoustic properties of the formation layers ahead of the drilling tool. For example, migration or seismic processing techniques may be used that operate based on the concept of back propagation of the waves. A seismic profile from the surface may be used as an initial model for seismic processing. Velocities associated with layering may be computed though the use of a sonic tool in the BHA, e.g., through well-tying. The determined velocities may then be used as a-priori information for the geological model. The operation of an ultra-deep reading tool may be supplemented through the use of sensor data collection and analysis techniques based on the electromagnetic and acoustic waves produced by pulsed drilling operations, as described herein. In one example, an ultra-deep reading tool may be used first to provide formation mapping around the BHA within approximately 100 feet of the BHA. Subsequently, the sensor data collection and analysis techniques described herein may be used to provide formation mapping within a range of approximately 100 to 500 feet of the BHA. The ultra-deep reading tool results for the 100 foot range may be used as an initial guess or a-priori information when determining the formation models for the 100 to 500 foot range. Model-based optimization techniques may also be used to estimate the distribution of the electrical and acoustic properties.

Other methods with which to evaluate the layers ahead of the drilling tool use a statistical analysis of the measurements representing responses of electromagnetic and/or acoustic sensors or sensor arrays. Such statistical approaches may, for example, provide an estimate of the amount of variation that is expected to exist in the properties of the formation layers ahead of the tool relative to the properties of a formation layer through which the drilling tool is currently moving or through which the drilling tool previously moved.

FIG. 9 is a block diagram illustrating an exemplary sensor analysis system associated with a pulsed-power drilling system. Sensor analysis system 900 may be positioned at the surface for use with pulsed-power drilling system 100 as illustrated in FIG. 1, or at any other suitable location. Sensor analysis system 900 may be configured to determine formation characteristics using reference sensor responses recorded during pulsed drilling operations.

In the illustrated embodiment, sensor analysis system 900 may include a processing unit 910 coupled to one or more input/output interfaces 920 and data storage 918 over an interconnect 916. Interconnect 916 may be implemented using any suitable computing system interconnect mechanism or protocol. Processing unit 910 may be configured to determine characteristics of a formation ahead of the drilling tool based, at least in part, on inputs received by input/output interfaces 920, some of which may include measurements representing responses recorded by various sensors within wellbore 116, such as voltages, currents, ratios of voltages to current, electric field strengths or magnetic field strengths.

For example, processing unit 910 may be configured to perform one or more inversions based on simulation models that relate the electromagnetic properties of the formation to electromagnetic data and/or relate the acoustic properties of the formation to acoustic data.

Processing unit 910 may include processor 912 that is any system, device, or apparatus configured to interpret and/or execute program instructions and/or process data associated with sensor analysis system 900. Processor 912 may be, without limitation, a microprocessor, microcontroller, digital signal processor (DSP), application specific integrated circuit (ASIC), or any other digital or analog circuitry configured to interpret and/or execute program instructions and/or process data. In some embodiments, processor 912 may interpret and/or execute program instructions and/or process data stored in one or more computer-readable media 914 included in processing unit 910 to perform any of the methods described herein.

Computer-readable media 914 may be communicatively coupled to processor 912 and may include any system, device, or apparatus configured to retain program instructions and/or data for a period of time (e.g., computer-readable media). Computer-readable media 914 may include random access memory (RAM), read-only memory (ROM), solid state memory, electrically erasable programmable read-only memory (EEPROM), disk-based memory, a PCMCIA card, flash memory, magnetic storage, opto-magnetic storage, or any suitable selection and/or array of volatile or non-volatile memory that retains data after power to processing unit 910 is turned off. In accordance with some embodiments of the present disclosure, computer-readable media 914 may include instructions for determining one or more characteristics of formation 118 based on signals received from various acoustic, electrical or electromagnetic sensors by input/output interfaces 920.

As described above, input/output interfaces 920 may be coupled to an optical fiber over which it may send and receive signals. Signals received by input/output interfaces 920 may include measurements representing responses recorded by various sensors at the surface or downhole during a pulsed drilling operation. For example, signals received by input/output interfaces 920 may include measurements representing responses recorded by various acoustic, electrical or electromagnetic sensors. These measurements may include, without limitation, measurements of voltage, current, electric field strength, or magnetic field strength.

Data storage 918 may provide and/or store data and instructions used by processor 912 to perform any of the methods described herein for collecting and analyzing data from acoustic, electrical or electromagnetic sensors. In particular, data storage 918 may store data that may be loaded into computer-readable media 914 during operation of sensor analysis system 900. Data storage 918 may be implemented in any suitable manner, such as by functions, instructions, logic, or code, and may be stored in, for example, a relational database, file, application programming interface, library, shared library, record, data structure, service, software-as-service, or any other suitable mechanism. Data storage 918 may store and/or specify any suitable parameters that may be used to perform the described methods. For example, data storage 918 may provide information used to direct components of sensor analysis system 900 to analyze measurements representing responses recorded by various acoustic, electrical or electromagnetic sensors, including at least one reference sensor, during a pulsed drilling operation to determine one or more characteristics of a formation, such as formation 118 as shown in FIG. 1. Information stored in data storage 918 may also include one or more models generated or accessed by processing unit 910. For example, data storage 918 may store a model used in an inversion process, as described with respect to FIG. 6.

The elements shown in FIG. 9 are exemplary only and sensor analysis system 900 may include fewer or additional elements in other embodiments. Modifications, additions, or omissions may be made to sensor analysis system 900 without departing from the scope of the present disclosure. For example, sensor analysis system 900 illustrates one particular configuration of components, but any suitable configuration of components may be used. Components of sensor analysis system 900 may be implemented either as physical or logical components. Furthermore, in some embodiments, functionality associated with components of sensor analysis system 900 may be implemented with special and/or general purpose circuits or components. Components of sensor analysis system 900 may also be implemented by computer program instructions.

Embodiments herein may include:

A. A downhole drilling system including a drill bit including a first electrode and a second electrode electrically coupled to a pulse-generating circuit to receive pulse drilling signals from the pulse-generating circuit during a pulsed drilling operation in a wellbore; a reference sensor positioned in proximity to the drill bit; an additional sensor positioned uphole from the reference sensor; and a sensor analysis system communicatively coupled to the reference sensor and to the additional sensor, the sensor analysis system comprising: a processor; and a computer readable storage medium storing program instructions that when read and executed by the processor cause the processor to: obtain measurements representing responses recorded simultaneously by the reference sensor and by the additional sensor during the pulsed drilling operation; generate modified measurements in which effects of variations in the pulse drilling signal on the measurements representing responses recorded by the additional sensor are reduced based on the measurements representing responses recorded by the reference sensor; and determine, based on the modified measurements, a characteristic of a formation downhole from the drill bit.

B. A method including performing a pulsed drilling operation in a wellbore using a drill bit including a first electrode and a second electrode electrically coupled to a pulse-generating circuit to receive pulse drilling signals from the pulse-generating circuit during a pulsed drilling operation, a reference sensor positioned in proximity to the drill bit and an additional sensor positioned uphole from the reference sensor; obtaining measurements representing responses recorded simultaneously by the reference sensor and by the additional sensor during the pulsed drilling operation; generating modified measurements in which effects of variations in the pulse drilling signal on the measurements representing responses recorded by the additional sensor are reduced based on the measurements representing responses recorded by the reference sensor; and determining, based on the modified measurements, a characteristic of a formation downhole from the drill bit.

C. A sensor analysis system including a processor and a computer readable storage medium storing program instructions that when read and executed by the processor cause the processor to receive measurements representing responses recorded simultaneously by a reference sensor positioned in proximity to a drill bit and by an additional sensor positioned uphole from the reference sensor during a pulsed drilling operation in a wellbore, generate modified measurements based on the measurements representing responses recorded by the reference sensor to reduce an effect of a variation in pulse drilling signals received from a pulse-generating circuit during the pulsed drilling operation on the measurements representing responses recorded by the additional sensor, and determine, based on the modified measurements, a characteristic of a formation downhole from the drill bit.

Each of embodiments A, B and C may have one or more of the following additional elements in any combination: Element 1: wherein each of the reference sensor and the additional sensor includes an acoustic sensor that records acoustic waves produced by the pulsed drilling operation; and the characteristic of the formation includes at least one of density, shear velocity, compressed velocity and Young's modulus. Element 2: wherein each of the reference sensor and the additional sensor includes an electromagnetic sensor that records electromagnetic waves produced by the pulsed drilling operation; and the characteristic of the formation includes at least one of electrical conductivity, dielectric permeability and magnetic permeability. Element 3: wherein each of the reference sensor and the additional sensor includes an acoustic sensor that records acoustic waves produced by the pulsed drilling operation and an electromagnetic sensor that records electromagnetic waves produced by the pulsed drilling operation; and determining the characteristic comprises performing an acoustic inversion based on the recorded acoustic waves; and performing an electromagnetic inversion based on the recorded electromagnetic waves. Element 4: wherein each of the reference sensor and the additional sensor includes an acoustic sensor that records acoustic waves produced by the pulsed drilling operation and an electromagnetic sensor that records electromagnetic waves produced by the pulsed drilling operation; and determining the characteristic comprises performing an inversion based on the recorded acoustic waves and on the recorded electromagnetic waves. Element 5: wherein the system comprises two or more additional sensors positioned uphole from the reference sensor, including the additional sensor. Element 6: wherein the determined characteristic is a characteristic of a first layer of the formation downhole from the drill bit; and the sensor analysis system is further configured to determine a position, with respect to the drill bit, of a transition between a second layer of the formation that does not exhibit the determined characteristic and the first layer of the formation. Element 7: wherein generating the modified measurements comprises converting a first signal recorded by the additional sensor to the frequency domain; converting a second signal recorded by the reference sensor to the frequency domain; and determining, in the frequency domain, a ratio of the first signal to the second signal. Element 8: wherein the system further comprises a transmitter that is activated during the pulsed drilling operation; and generating the modified measurements comprises: converting a first signal recorded by the additional sensor to the frequency domain; converting a second signal recorded by the reference sensor to the frequency domain; generating a modified second signal by multiplying, in the frequency domain, the second signal by a constant; and subtracting, in the frequency domain, the modified second signal from the first signal. Element 9: wherein the system further comprises a transmitter positioned at a surface above the formation that is activated during the pulsed drilling operation; and generating the modified measurements comprises: converting a first signal recorded by the additional sensor to the frequency domain; converting a second signal recorded by the reference sensor to the frequency domain; generating a modified second signal by multiplying, in the frequency domain, the second signal by a constant; and subtracting, in the frequency domain, the modified second signal from the first signal. Element 10: wherein the system further comprises a drill string including the drill bit and the reference sensor; and the drill string further includes an isolator positioned to block pulse drilling signals from travelling along the drill string toward the reference sensor and the additional sensor. Element 11: wherein the system further comprises a drill string including the drill bit and the reference sensor; and the drill string further includes the additional sensor. Element 12: wherein the additional sensor is positioned at a surface above the formation. Element 13: wherein the additional sensor is located in a wellbore other than the wellbore in which the pulsed drilling operation is performed. Element 14: wherein the additional sensor comprises a distributed acoustic sensing system; and determining the characteristic is further based on measurements representing responses recorded by the distributed acoustic sensing system. Element 15: wherein the sensor analysis system is further configured to generate dispersion characteristics of the pulse drilling signals with respect to a borehole wave-propagation mode; and determining the characteristic comprises applying a dispersion correction based on the generated dispersion characteristics. Element 16: wherein the sensor analysis system is further configured to cause modification of an operating parameter of the pulsed drilling operation based on the determined characteristic of the formation.

Although the present disclosure has been described with several embodiments, various changes and modifications may be suggested to one skilled in the art. It is intended that the present disclosure encompasses such various changes and modifications as falling within the scope of the appended claims.

What is claimed is:

1. A downhole drilling system, comprising:

a drill bit including a first electrode and a second electrode electrically coupled to a pulse-generating circuit to receive pulse drilling signals from the pulse-generating circuit during a pulsed drilling operation in a wellbore;

a reference sensor positioned in proximity to the drill bit;

an additional sensor positioned on a surface that is outside of the wellbore; and a sensor analysis system communicatively coupled to the reference sensor and to the additional sensor, the sensor analysis system comprising:

a processor; and a computer readable storage medium storing program instructions that when read and executed by the processor cause the processor to:

obtain measurements representing responses recorded simultaneously by the reference sensor and by the additional sensor during the pulsed drilling operation;

generate modified measurements based on the measurements representing responses recorded by the reference sensor to reduce an effect of a variation in the pulse drilling signal on the measurements representing responses recorded by the additional sensor; and determine, based on the modified measurements, a characteristic of a formation downhole from the drill bit.

2. The system of claim 1, wherein:

each of the reference sensor and the additional sensor includes an acoustic sensor that records acoustic waves produced by the pulsed drilling operation; and the characteristic of the formation includes at least one of density, shear velocity, compressed velocity and Young's modulus.

3. The system of claim 1, wherein:

each of the reference sensor and the additional sensor includes an electromagnetic sensor that records electromagnetic waves produced by the pulsed drilling operation; and the characteristic of the formation includes at least one of electrical conductivity, dielectric permeability and magnetic permeability.

4. The system of claim 1, wherein:

each of the reference sensor and the additional sensor includes an acoustic sensor that records acoustic waves produced by the pulsed drilling operation and an electromagnetic sensor that records electromagnetic waves produced by the pulsed drilling operation; and determining the characteristic comprises:

performing an acoustic inversion based on the recorded acoustic waves; and performing an electromagnetic inversion based on the recorded electromagnetic waves.

5. The system of claim 1, wherein:

each of the reference sensor and the additional sensor includes an acoustic sensor that records acoustic waves produced by the pulsed drilling operation and an electromagnetic sensor that records electromagnetic waves produced by the pulsed drilling operation; and determining the characteristic comprises performing an inversion based on the recorded acoustic waves and on the recorded electromagnetic waves.

6. The system of claim 1, wherein the system comprises two or more additional sensors positioned uphole from the reference sensor, including the additional sensor.

7. The system of claim 1, wherein:

the determined characteristic is a characteristic of a first layer of the formation downhole from the drill bit; and the program instructions, when read and executed by the processor, further cause the processor to determine a position, with respect to the drill bit, of a transition between a second layer of the formation that does not exhibit the determined characteristic and the first layer of the formation.

8. The system of claim 1, wherein generating the modified measurements comprises:

converting a first signal recorded by the additional sensor to the frequency domain;

converting a second signal recorded by the reference sensor to the frequency domain; and determining, in the frequency domain, a ratio of the first signal to the second signal.

9. The system of claim 1, wherein:

the system further comprises a transmitter that is activated during the pulsed drilling operation; and generating the modified measurements comprises:

converting a first signal recorded by the additional sensor to the frequency domain;

converting a second signal recorded by the reference sensor to the frequency domain;

generating a modified second signal by multiplying, in the frequency domain, the second signal by a constant; and subtracting, in the frequency domain, the modified second signal from the first signal.

10. The system of claim 1, wherein:

the system further comprises a transmitter positioned at the surface that is outside of the wellbore that is activated during the pulsed drilling operation; and generating the modified measurements comprises:

converting a first signal recorded by the additional sensor to the frequency domain;

converting a second signal recorded by the reference sensor to the frequency domain;

generating a modified second signal by multiplying, in the frequency domain, the second signal by a constant; and subtracting, in the frequency domain, the modified second signal from the first signal.

11. The system of claim 1, wherein:

the system further comprises a drill string including the drill bit and the reference sensor; and the drill string further includes an isolator positioned to block pulse drilling signals from travelling along the drill string toward the reference sensor and the additional sensor.

12. The system of claim 1, wherein:

the system further comprises a drill string including the drill bit and the reference sensor; and the drill string further includes the additional sensor.

13. The system of claim 1, wherein:

the additional sensor comprises a distributed acoustic sensing system; and determining the characteristic is further based on measurements representing responses recorded by the distributed acoustic sensing system.

14. The system of claim 1, wherein:

the program instructions, when read and executed by the processor, further cause the processor to generate dispersion characteristics of the pulse drilling signals with respect to a borehole wave-propagation mode; and determining the characteristic comprises applying a dispersion correction based on the generated dispersion characteristics.

15. The system of claim 1, wherein the program instructions, when read and executed by the processor, further cause the processor to cause modification of an operating parameter of the pulsed drilling operation based on the determined characteristic of the formation.

16. A method, comprising:

performing a pulsed drilling operation in a wellbore using:

a drill bit including a first electrode and a second electrode electrically coupled to a pulse-generating circuit to receive pulse drilling signals from the pulse-generating circuit during the pulsed drilling operation;

a reference sensor positioned in proximity to the drill bit;

an additional sensor positioned on a surface that is outside of the wellbore;

obtaining measurements representing responses recorded simultaneously by the reference sensor and by the additional sensor during the pulsed drilling operation;

generating modified measurements based on the measurements representing responses recorded by the reference sensor to reduce an effect of a variation in the pulse drilling signal on the measurements representing responses recorded by the additional sensor; and determining, based on the modified measurements, a characteristic of a formation downhole from the drill bit.

17. The method of claim 16, wherein:

each of the reference sensor and the additional sensor includes an acoustic sensor that records acoustic waves produced by the pulsed drilling operation; and the characteristic of the formation includes at least one of density, shear velocity, compressed velocity and Young's modulus.

18. The method of claim 16, wherein:

each of the reference sensor and the additional sensor includes an electromagnetic sensor that records electromagnetic waves produced by the pulsed drilling operation; and the characteristic of the formation includes at least one of electrical conductivity, dielectric permeability and magnetic permeability.

19. The method of claim 16, wherein:

each of the reference sensor and the additional sensor includes an acoustic sensor that records acoustic waves produced by the pulsed drilling operation and an electromagnetic sensor that records electromagnetic waves produced by the pulsed drilling operation; and determining the characteristic comprises:

performing an acoustic inversion based on the recorded acoustic waves; and performing an electromagnetic inversion based on the recorded electromagnetic waves.

20. The method of claim 16, wherein:

each of the reference sensor and the additional sensor includes an acoustic sensor that records acoustic waves produced by the pulsed drilling operation and an electromagnetic sensor that records electromagnetic waves produced by the pulsed drilling operation; and determining the characteristic comprises performing an inversion based on the recorded acoustic waves and on the recorded electromagnetic waves.

21. The method of claim 16, wherein:

the determined characteristic is a characteristic of a first layer of the formation downhole from the drill bit; and the method further comprises determining a position, with respect to the drill bit, of a transition between a second layer of the formation that does not exhibit the determined characteristic and the first layer of the formation.

22. The method of claim 16, wherein generating the modified measurements comprises:

converting a first signal recorded by the additional sensor to the frequency domain;

converting a second signal recorded by the reference sensor to the frequency domain; and determining, in the frequency domain, a ratio of the first signal to the second signal.

23. The method of claim 16, wherein generating the modified measurements comprises:

converting a first signal recorded by the additional sensor to the frequency domain;

converting a second signal recorded by the reference sensor to the frequency domain;

generating a modified second signal by multiplying, in the frequency domain, the second signal by a constant; and subtracting, in the frequency domain, the modified second signal from the first signal.

24. The method of claim 16, wherein:

the additional sensor comprises a distributed acoustic sensing system; and determining the characteristic is further based on measurements representing responses recorded by the distributed acoustic sensing system.

25. The method of claim 16, wherein:

the method further comprises generating dispersion characteristics of the pulse drilling signals with respect to a borehole wave-propagation mode; and determining the characteristic comprises applying a dispersion correction based on the generated dispersion characteristics.

26. The method of claim 16, further comprising modifying an operating parameter of the pulsed drilling operation based on the determined characteristic of the formation.

27. A sensor analysis system, comprising:

a processor; and a computer readable storage medium storing program instructions that when read and executed by the processor cause the processor to:

receive measurements representing responses recorded simultaneously by a reference sensor positioned in proximity to a drill bit and by an additional sensor positioned on a surface that is outside of the wellbore during a pulsed drilling operation in a wellbore;

generate modified measurements based on the measurements representing responses recorded by the reference sensor to reduce an effect of a variation in pulse drilling signals received from a pulse-generating circuit during the pulsed drilling operation on the measurements representing responses recorded by the additional sensor; and determine, based on the modified measurements, a characteristic of a formation downhole from the drill bit.

28. The system of claim 27, wherein:

each of the reference sensor and the additional sensor includes an acoustic sensor that records acoustic waves produced by the pulsed drilling operation; and the characteristic of the formation includes at least one of density, shear velocity, compressed velocity and Young's modulus.

29. The system of claim 27, wherein:

each of the reference sensor and the additional sensor includes an electromagnetic sensor that records electromagnetic waves produced by the pulsed drilling operation; and the characteristic of the formation includes at least one of electrical conductivity, dielectric permeability and magnetic permeability.

30. The system of claim 27, wherein:

each of the reference sensor and the additional sensor includes an acoustic sensor that records acoustic waves produced by the pulsed drilling operation and an electromagnetic sensor that records electromagnetic waves produced by the pulsed drilling operation; and determining the characteristic comprises:

performing an acoustic inversion based on the recorded acoustic waves; and performing an electromagnetic inversion based on the recorded electromagnetic waves.

31. The system of claim 27, wherein:

each of the reference sensor and the additional sensor includes an acoustic sensor that records acoustic waves produced by the pulsed drilling operation and an electromagnetic sensor that records electromagnetic waves produced by the pulsed drilling operation; and determining the characteristic comprises performing an inversion based on the recorded acoustic waves and on the recorded electromagnetic waves.

32. The system of claim 27, wherein:

the determined characteristic is a characteristic of a first layer of the formation downhole from the drill bit; and the program instructions, when read and executed by the processor, further cause the processor to determine a position, with respect to the drill bit, of a transition between a second layer of the formation that does not exhibit the determined characteristic and the first layer of the formation.

33. The system of claim 27, wherein generating the modified measurements comprises:

converting a first signal recorded by the additional sensor to the frequency domain;

converting a second signal recorded by the reference sensor to the frequency domain; and determining, in the frequency domain, a ratio of the first signal to the second signal.

34. The system of claim 27, wherein generating the modified measurements comprises:

converting a first signal recorded by the additional sensor to the frequency domain;

converting a second signal recorded by the reference sensor to the frequency domain;

generating a modified second signal by multiplying, in the frequency domain, the second signal by a constant; and subtracting, in the frequency domain, the modified second signal from the first signal.

35. The system of claim 27, wherein:

the additional sensor comprises a distributed acoustic sensing system; and determining the characteristic is further based on measurements representing responses recorded by the distributed acoustic sensing system.

36. The system of claim 27, wherein:

the program instructions, when read and executed by the processor, further cause the processor to generate dispersion characteristics of the pulse drilling signals with respect to a borehole wave-propagation mode; and determining the characteristic comprises applying a dispersion correction based on the generated dispersion characteristics.

37. The system of claim 27, wherein the program instructions, when read and executed by the processor, further cause the processor to cause modification of an operating parameter of the pulsed drilling operation based on the determined characteristic of the formation.

* * * * *